US007551142B1

(12) United States Patent
Zhang et al.

(10) Patent No.: US 7,551,142 B1
(45) Date of Patent: Jun. 23, 2009

(54) HYBRID ANTENNAS WITH DIRECTLY FED ANTENNA SLOTS FOR HANDHELD ELECTRONIC DEVICES

(75) Inventors: Zhijun Zhang, Beijing (CN); Robert J. Hill, Salinas, CA (US); Robert W. Schlub, Campbell, CA (US); Juan Zavala, Watsonville, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 11/956,314

(22) Filed: Dec. 13, 2007

(51) Int. Cl.
*H01Q 1/24* (2006.01)

(52) U.S. Cl. ..... 343/702; 343/700 MS

(58) Field of Classification Search ..... 343/700 MS, 343/702
See application file for complete search history.

(56) References Cited

U.S. PATENT DOCUMENTS

| | | | | |
|---|---|---|---|---|
| 6,670,923 | B1 | 12/2003 | Kadambi et al. | |
| 6,741,214 | B1 | 5/2004 | Kadambi et al. | |
| 6,747,601 | B2 | 6/2004 | Boyle | |
| 6,856,294 | B2 | 2/2005 | Kadambi et al. | |
| 6,980,154 | B2 | 12/2005 | Vance et al. | |
| 7,027,838 | B2 | 4/2006 | Zhou et al. | |
| 7,116,267 | B2 | 10/2006 | Schuster et al. | |
| 7,119,747 | B2 | 10/2006 | Lin et al. | |
| 7,123,208 | B2 | 10/2006 | Puente Baliarda et al. | |
| 2003/0107518 | A1 | 6/2003 | Li et al. | |
| 2004/0145521 | A1 | 7/2004 | Hebron et al. | |
| 2004/0257283 | A1 * | 12/2004 | Asano et al. | 343/702 |
| 2006/0055606 | A1 | 3/2006 | Boyle | |
| 2008/0231521 | A1 * | 9/2008 | Anguera Pros et al. | 343/702 |

OTHER PUBLICATIONS

Hill et al. U.S. Appl. No. 11/650,187, filed Jan. 4, 2007.
Hill et al. U.S. Appl. No. 11/821,192, filed Jun. 21, 2007.
Hill et al. U.S. Appl. No. 11/897,033, filed Aug. 28, 2007.
Zhang et al. U.S. Appl. No. 11/895,053, filed Aug. 22, 2007.

* cited by examiner

*Primary Examiner*—Anh Q Tran
(74) *Attorney, Agent, or Firm*—Treyz Law Group; G. Victor Treyz; David C. Kellogg

(57) ABSTRACT

A handheld electronic device is provided that contains wireless communications circuitry. The wireless communications circuitry may include antennas. An antenna in the handheld electronic device may have a ground plane element. A slot antenna resonating element may be formed from an opening in the ground plane element. A near-field-coupled antenna resonating element may be electromagnetically coupled to the slot antenna resonating element through electromagnetic near-field coupling. A transmission line may directly feed the slot antenna resonating element. The transmission line may indirectly feed the near-field-coupled antenna resonating element through the slot antenna resonating element. The slot antenna resonating element may have one or more associated resonant frequencies and the near-field-coupled antenna resonating element may have one or more associated resonant frequencies. The antenna may be configured to cover one or more distinct communications bands.

14 Claims, 24 Drawing Sheets

HYBRID ANTENNAS WITH DIRECTLY FED ANTENNA SLOTS FOR HANDHELD ELECTRONIC DEVICES

BACKGROUND

This invention relates generally to wireless communications circuitry, and more particularly, to wireless communications circuitry for handheld electronic devices.

Handheld electronic devices are becoming increasingly popular. Examples of handheld devices include handheld computers, cellular telephones, media players, and hybrid devices that include the functionality of multiple devices of this type.

Due in part to their mobile nature, handheld electronic devices are often provided with wireless communications capabilities. Handheld electronic devices may use long-range wireless communications to communicate with wireless base stations. For example, cellular telephones may communicate using cellular telephone bands at 850 MHz, 900 MHz, 1800 MHz, and 1900 MHz. Handheld electronic devices may also use short-range wireless communications links. For example, handheld electronic devices may communicate using the Wi-Fi® (IEEE 802.11) band at 2.4 GHz and the Bluetooth® band at 2.4 GHz. Communications are also possible in data service bands such as the 3G data communications band at 2170 MHz (commonly referred to as the UMTS or Universal Mobile Telecommunications System band). Handheld devices with Global Positioning System (GPS) capabilities receive GPS signals at 1575 MHz.

To satisfy consumer demand for small form factor wireless devices, manufacturers are continually striving to reduce the size of components that are used in these devices. For example, manufacturers have made attempts to miniaturize the antennas used in handheld electronic devices.

A typical antenna may be fabricated by patterning a metal layer on a circuit board substrate or may be formed from a sheet of thin metal using a foil stamping process. Antennas such as planar inverted-F antennas (PIFAs) and antennas based on L-shaped resonating elements can be fabricated in this way. Antennas such as PIFA antennas and antennas with L-shaped resonating elements can be used in handheld devices.

Although modern handheld electronic devices often need to function over fairly wide frequency bands or over a number of different communications bands, it is difficult to design a compact antenna that covers all frequencies of interest while satisfying design constraints related to antenna efficiency and immunity to proximity effects.

It would therefore be desirable to be able to provide improved antennas and wireless handheld electronic devices.

SUMMARY

Handheld electronic devices and antennas for handheld electronic devices are provided. A handheld electronic device may have conductive structures that form an antenna ground plane element. The ground plane element may have portions that define a slot antenna resonating element. Another antenna resonating element may be electromagnetically coupled to the slot antenna resonating element through electromagnetic near-field coupling. During operation, a coaxial cable or other transmission line in a handheld electronic device may directly feed the slot antenna resonating element and may indirectly feed the near-field-coupled antenna resonating element through the slot antenna resonating element.

The slot antenna resonating element may have multiple openings or branches that define multiple associated inner slot perimeters and thereby allow the slot antenna resonating element to resonate at multiple resonant frequencies. The near-field-coupled antenna resonating element may have multiple branches that allow the near-field-coupled antenna resonating element to resonate at multiple frequencies. The resonant peaks associated with the slot antenna resonating element portion of the antenna and the near-field-coupled antenna resonating element portion of the antenna can be configured to nearly or exactly coincide with each other to broadened the bandwidth of a given communications band or can be configured to provide coverage for distinct communications bands. In some configurations, the use of more than one antenna resonating element to transmit and receive radio-frequency signals for a handheld electronic device may make the antenna and handheld electronic device less susceptible to influences from a user's hand position.

A handheld electronic device may have a conductive housing and a conductive bezel. The conductive housing and conductive bezel may be used in defining the shape of the slot antenna resonating element. The slot antenna resonating element may be approximately rectangular in shape and may have a longitudinal axis. Non-rectangular shapes may also be used for the slot. The near-field-coupled antenna resonating element may have a portion that runs parallel to the longitudinal axis of the slot antenna resonating element and may have portions that run perpendicular to the longitudinal axis of the slot antenna resonating element while remaining parallel to a planar ground plane element.

The antenna may be provided with electrical components such as inductors and capacitors. For example, a capacitor may be placed across the slot antenna resonating element or may be used to terminate one end of the near-field-coupled resonating element to ground. An inductor may be incorporated at one end of the near-field-coupled resonating element or may be placed across the antenna feed terminals.

The near-field-coupled antenna resonating element may be formed from wires or other lengths of conductor or may contain planar portions that lie parallel to planar portions of the antenna's ground plane. For example, the near-field-coupled antenna resonating element may have planar conductive portions with multiple branches or serpentine paths that lie parallel to a planar ground plane element. The ground plane of the handheld electronic device may include planar elements such as a conductive housing or a printed circuit board ground conductor.

Further features of the invention, its nature and various advantages will be more apparent from the accompanying drawings and the following detailed description of the preferred embodiments.

DETAILED DESCRIPTION

The present invention relates generally to wireless communications, and more particularly, to wireless electronic devices and antennas for wireless electronic devices.

The wireless electronic devices may be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices. With one suitable arrangement, which is sometimes described herein as an example, the portable electronic devices are handheld electronic devices.

The handheld devices may be, for example, cellular telephones, media players with wireless communications capabilities, handheld computers (also sometimes called personal digital assistants), remote controllers, global positioning system (GPS) devices, and handheld gaming devices. The handheld devices may also be hybrid devices that combine the functionality of multiple devices of these types. Examples of hybrid handheld devices include a cellular telephone that includes media player functionality, a gaming device that includes a wireless communications capability, a cellular telephone that includes game and email functions, and a handheld device that receives email, supports mobile telephone calls, has music player functionality and supports web browsing. These are merely illustrative examples.

Figure 1:
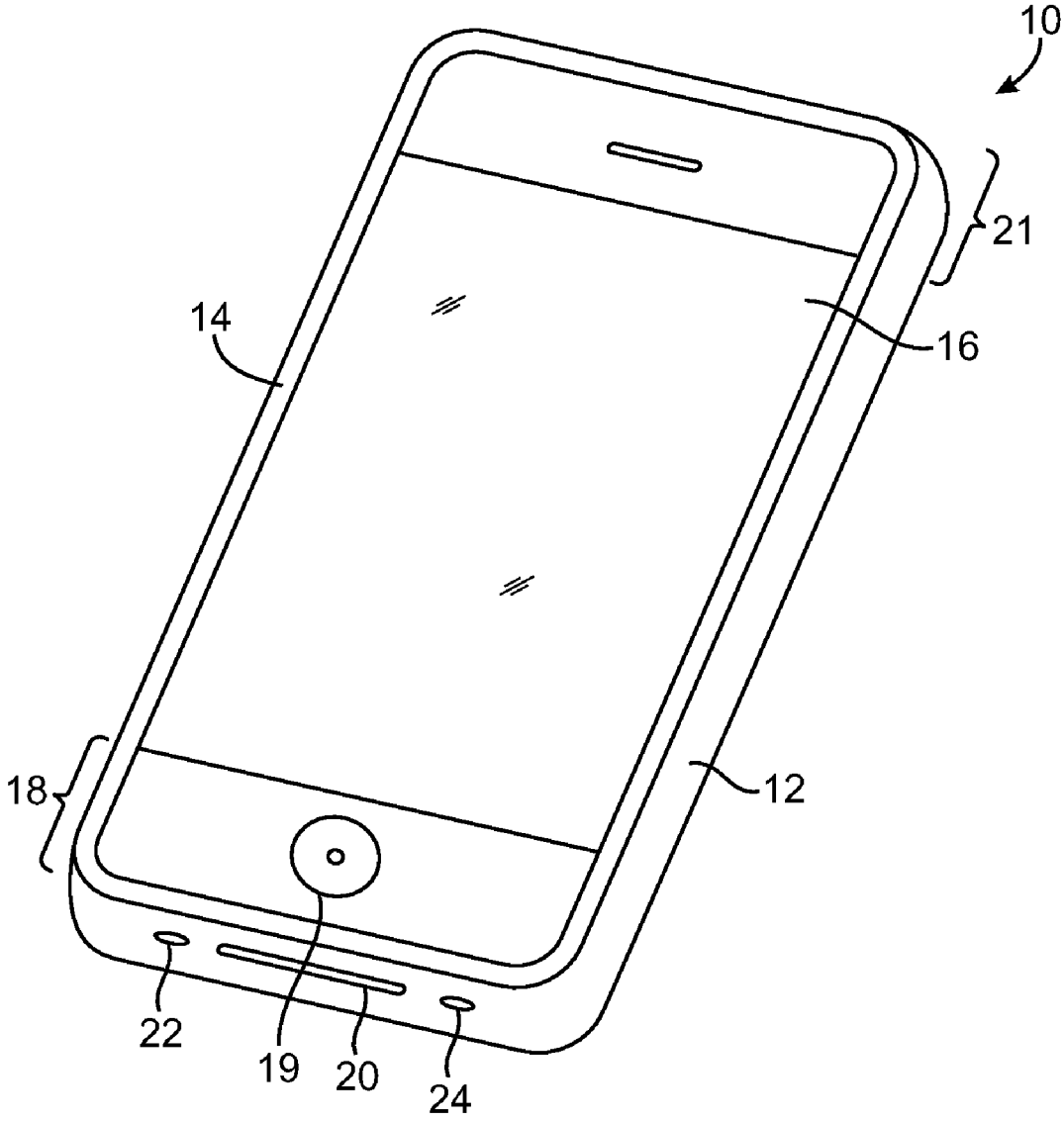
FIG. 1 is a perspective view of an illustrative handheld electronic device with antenna structures in accordance with an embodiment of the present invention.

An illustrative handheld electronic device in accordance with an embodiment of the present invention is shown in FIG. 1. Device 10 may be any suitable portable or handheld electronic device.

Device 10 may have housing 12 and may include one or more antennas for handling wireless communications. Device 10 may handle communications over multiple communications bands. For example, wireless communications circuitry in device 10 may be used to handle cellular telephone communications in one or more frequency bands and data communications in one or more communications bands. With one suitable arrangement, which is sometimes described herein as an example, the wireless communications circuitry of device 10 may use a first antenna that is configured to handle communications in one or more communications bands and may use a second antenna that is configured to handle communications in one or more additional communications band. The first antenna may, for example, handle communications in a communications band that is centered at 2.4 GHz (e.g., Wi-Fi and/or Bluetooth frequencies) while simultaneously receiving Global Positioning Systems (GPS) communications at 1575 MHz. The second antenna may handle cellular telephone communications bands and/or 3G data communications bands such as the Universal Mobile Telecommunications System (UMTS) 3G data communications band at 2170 MHz (as examples).

Housing 12, which is sometimes referred to as a case, may be formed of any suitable materials including plastic, glass, ceramics, metal, other suitable materials, or a combination of these materials. In some situations, housing 12 or portions of housing 12 may be formed from a dielectric or other low-conductivity material, so that the operation of conductive antenna elements that are located in proximity to housing 12 is not disrupted. Housing 12 or portions of housing 12 may also be formed from conductive materials such as metal.

An illustrative housing material that may be used is anodized aluminum. Aluminum is relatively light in weight and, when anodized, has an attractive insulating and scratch-resistant surface. If desired, other metals can be used for the housing of device 10, such as stainless steel, magnesium, titanium, alloys of these metals and other metals, etc. In scenarios in which housing 12 is formed from metal elements, one or more of the metal elements may be used as part of the antenna in device 10. For example, metal portions of housing 12 may be shorted to an internal ground plane in device 10 to create a larger ground plane element for that device 10. To facilitate electrical contact between an anodized aluminum housing and other metal components in device 10, portions of the anodized surface layer of the anodized aluminum housing may be selectively removed during the manufacturing process (e.g., by laser etching).

Housing 12 may have a bezel 14. The bezel 14 may be formed from a conductive material. The conductive material may be a metal (e.g., an elemental metal or an alloy) or other suitable conductive materials. With one suitable arrangement, which is sometimes described herein as an example, bezel 14 may be formed from stainless steel. Stainless steel can be manufactured so that it has an attractive shiny appearance, is structurally strong, and does not corrode easily. If desired, other structures may be used to form bezel 14. For example, bezel 14 may be formed from plastic that is coated with a shiny coating of metal or other suitable substances.

Bezel 14 may serve to hold a display or other device with a planar surface in place on device 10. As shown in FIG. 1, for example, bezel 14 may be used to hold display 16 in place by attaching display 16 to housing 12. Device 10 may have front and rear planar surfaces. In the example of FIG. 1, display 16 is shown as being formed as part of the planar front surface of device 10. The periphery of the front surface may be surrounded by bezel 14. If desired, the periphery of the rear surface may be surrounded by a bezel (e.g., in a device with both front and rear displays).

Display 16 may be a liquid crystal diode (LCD) display, an organic light emitting diode (OLED) display, or any other suitable display. The outermost surface of display 16 may be formed from one or more plastic or glass layers. If desired, touch screen functionality may be integrated into display 16 or may be provided using a separate touch pad device. An advantage of integrating a touch screen into display 16 to make display 16 touch sensitive is that this type of arrangement can save space and reduce visual clutter.

In a typical arrangement, bezel 14 may have prongs that are used to secure bezel 14 to housing 12 and that are used to electrically connect bezel 14 to housing 12 and other conductive elements in device 10. The housing and other conductive elements form a ground plane for the antenna(s) in the handheld electronic device. A gasket (e.g., an o-ring formed from silicone or other compliant material, a polyester film gasket, etc.) may be placed between the underside of bezel 14 and the outermost surface of display 16. The gasket may help to relieve pressure from localized pressure points that might otherwise place stress on the glass or plastic cover of display 16. The gasket may also help to visually hide portions of the interior of device 10 and may help to prevent debris from entering device 10.

In addition to serving as a retaining structure for display 16, bezel 14 may serve as a rigid frame for device 10. In this capacity, bezel 14 may enhance the structural integrity of device 10. For example, bezel 14 may make device 10 more rigid along its length than would be possible if no bezel were used. Bezel 14 may also be used to improve the appearance of device 10. In configurations such as the one shown in FIG. 1 in which bezel 14 is formed around the periphery of a surface of device 10 (e.g., the periphery of the front face of device 10), bezel 14 may help to prevent damage to display 16 (e.g., by shielding display 16 from impact in the event that device 10 is dropped, etc.).

Display screen 16 (e.g., a touch screen) is merely one example of an input-output device that may be used with handheld electronic device 10. If desired, handheld electronic device 10 may have other input-output devices. For example, handheld electronic device 10 may have user input control devices such as button 19, and input-output components such as port 20 and one or more input-output jacks (e.g., for audio and/or video). Button 19 may be, for example, a menu button. Port 20 may contain a 30-pin data connector (as an example). Openings 24 and 22 may, if desired, form microphone and speaker ports. Display screen 16 may be, for example, a liquid crystal display (LCD), an organic light-emitting diode (OLED) display, a plasma display, or multiple displays that use one or more different display technologies. In the example of FIG. 1, display screen 16 is shown as being mounted on the front face of handheld electronic device 10, but display screen 16 may, if desired, be mounted on the rear face of handheld electronic device 10, on a side of device 10, on a flip-up portion of device 10 that is attached to a main body portion of device 10 by a hinge (for example), or using any other suitable mounting arrangement.

A user of handheld device 10 may supply input commands using user input interface devices such as button 19 and touch screen 16. Suitable user input interface devices for handheld electronic device 10 include buttons (e.g., alphanumeric keys, power on-off, power-on, power-off, and other specialized buttons, etc.), a touch pad, pointing stick, or other cursor control device, a microphone for supplying voice commands, or any other suitable interface for controlling device 10. Although shown as being formed on the top face of handheld electronic device 10 in the example of FIG. 1, buttons such as button 19 and other user input interface devices may generally be formed on any suitable portion of handheld electronic device 10. For example, a button such as button 19 or other user interface control may be formed on the side of handheld electronic device 10. Buttons and other user interface controls can also be located on the top face, rear face, or other portion of device 10. If desired, device 10 can be controlled remotely (e.g., using an infrared remote control, a radio-frequency remote control such as a Bluetooth remote control, etc.).

Handheld device 10 may have ports such as port 20. Port 20, which may sometimes be referred to as a dock connector, 30-pin data port connector, input-output port, or bus connector, may be used as an input-output port (e.g., when connecting device 10 to a mating dock connected to a computer or other electronic device). Device 10 may also have audio and video jacks that allow device 10 to interface with external components. Typical ports include power jacks to recharge a battery within device 10 or to operate device 10 from a direct current (DC) power supply, data ports to exchange data with external components such as a personal computer or peripheral, audio-visual jacks to drive headphones, a monitor, or other external audio-video equipment, a subscriber identity module (SIM) card port to authorize cellular telephone service, a memory card slot, etc. The functions of some or all of these devices and the internal circuitry of handheld electronic device 10 can be controlled using input interface devices such as touch screen display 16.

Components such as display 16 and other user input interface devices may cover most of the available surface area on the front face of device 10 (as shown in the example of FIG. 1) or may occupy only a small portion of the front face of device 10. Because electronic components such as display 16 often contain large amounts of metal (e.g., as radio-frequency shielding), the location of these components relative to the antenna elements in device 10 should generally be taken into consideration. Suitably chosen locations for the antenna elements and electronic components of the device will allow the antennas of handheld electronic device 10 to function properly without being disrupted by the electronic components.

Handheld electronic device 10 may have one or more antennas. For example, handheld electronic device may have a first antenna that is located in the upper end of device 10 in region 21 and a second antenna that is located in the lower end of device 10 in region 18. Additional antennas or only a single antenna may be used in device 10 if desired.

In an illustrative arrangement with two antennas, the first antenna may be a multiband antenna that covers two or more frequency bands of interest such as the Wi-Fi/Bluetooth band at 2.4 GHz and the GPS band at 1575 MHz and the second antenna may be used to cover bands such as cellular telephone bands, data bands (e.g., 3G data bands), etc. An advantage of locating the first and second antennas at opposite ends of device 10 is that this separates the antennas from each other and helps to reduce the possibility of radio-frequency interference.

Figure 2:
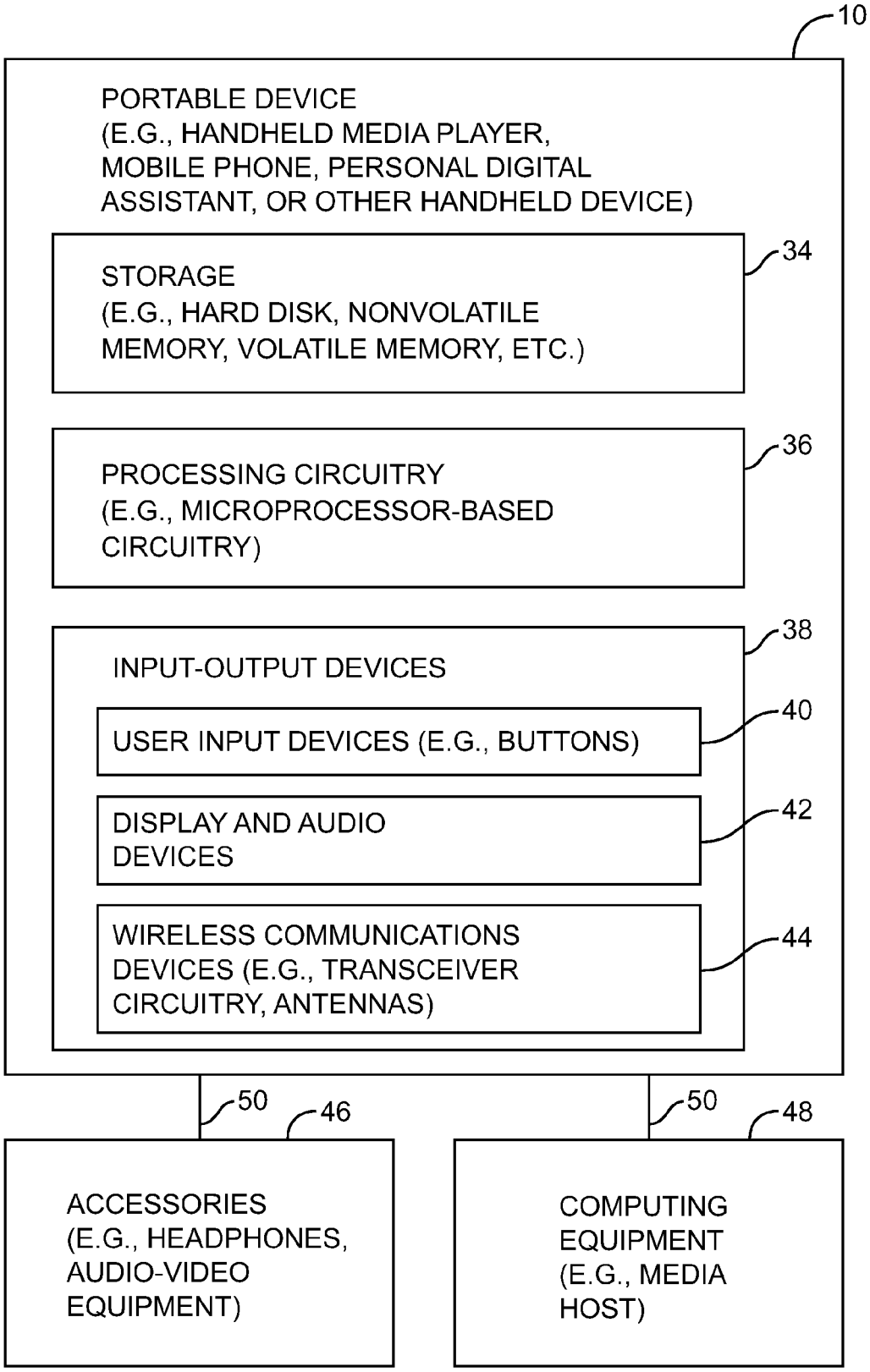
FIG. 2 is a schematic diagram of an illustrative handheld electronic device with antenna structures in accordance with an embodiment of the present invention.

A schematic diagram of an embodiment of an illustrative handheld electronic device is shown in FIG. 2. Handheld device 10 may be a mobile telephone, a mobile telephone with media player capabilities, a handheld computer, a remote control, a game player, a global positioning system (GPS) device, a combination of such devices, or any other suitable portable electronic device.

As shown in FIG. 2, handheld device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits. With one suitable arrangement, processing circuitry 36 and storage 34 are used to run software on device 10, such as internet browsing applications, voice-over-internet-protocol (VOIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as Wi-Fi®), protocols for other short-range wireless communications links such as the Bluetooth® protocol, protocols for handling 3G data services such as UMTS, Global Positioning System (GPS) protocols, cellular telephone communications protocols, etc.

Input-output devices 38 may be used to allow data to be supplied to device 10 and to allow data to be provided from device 10 to external devices. Display screen 16, button 19, microphone port 24, speaker port 22, and dock connector port 20 are examples of input-output devices 38.

Input-output devices 38 can include user input-output devices 40 such as buttons, touch screens, joysticks, click wheels, scrolling wheels, touch pads, key pads, keyboards, microphones, cameras, etc. A user can control the operation of device 10 by supplying commands through user input devices 40. Display and audio devices 42 may include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, one or more antennas, and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content).

Computing equipment 48 may be any suitable computer. With one suitable arrangement, computing equipment 48 is a computer that has an associated wireless access point (router) or an internal or external wireless card that establishes a wireless connection with device 10. The computer may be a server (e.g., an internet server), a local area network computer with or without internet access, a user's own personal computer, a peer device (e.g., another handheld electronic device 10), or any other suitable computing equipment.

The antenna structures and wireless communications devices of device 10 may support communications over any suitable wireless communications bands. For example, wireless communications devices 44 may be used to cover communications frequency bands such as the cellular telephone bands at 850 MHz, 900 MHz, 1800 MHz, and 1900 MHz, data service bands such as the 3G data communications band at 2170 MHz (commonly referred to as the UMTS or Universal Mobile Telecommunications System band), the Wi-Fi® (IEEE 802.11) bands at 2.4 GHz and 5.0 GHz (also sometimes referred to as wireless local area network or WLAN bands), the Bluetooth® band at 2.4 GHz, and the global positioning system (GPS) band at 1575 MHz. The 850 MHz band is sometimes referred to as the Global System for Mobile (GSM) communications band. The 900 MHz communications band is sometimes referred to as the Extended GSM (EGSM) band. The 1800 MHz band is sometimes referred to as the Digital Cellular System (DCS) band. The 1900 MHz band is sometimes referred to as the Personal Communications Service (PCS) band.

Device 10 can cover these communications bands and/or other suitable communications bands with proper configuration of the antenna structures in wireless communications circuitry 44.

Figure 3:
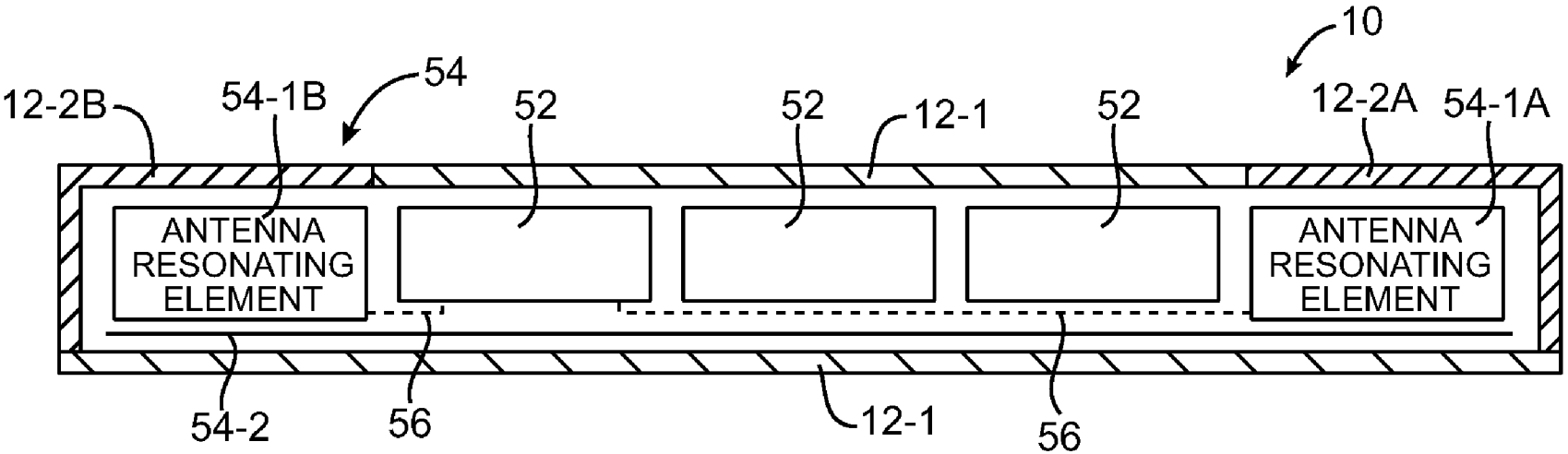
FIG. 3 is a cross-sectional side view of an illustrative handheld electronic device with antenna structures in accordance with an embodiment of the present invention.

A cross-sectional view of an illustrative handheld electronic device is shown in FIG. 3. In the example of FIG. 3, device 10 has a housing that is formed of a conductive portion 12-1 and dielectric portions 12-2A and 12-2B (e.g., portions 12-2A and 12-2B that are formed from plastic). Conductive portion 12-1 may be any suitable conductor such as aluminum, magnesium, stainless steel, alloys of these metals and other metals, etc. Conductive portion 12-1 may include a substantially rectangular conductive rear housing surface and housing side walls. Dielectric portions 12-2A and 12-2B may serve as caps that cover antennas that are mounted within housing 12. With one suitable arrangement, dielectric portions 12-2A and 12-2B may lie flush with the exterior surfaces of housing 12 (i.e., with the rear surface and sidewall surfaces of conductive housing portion 12-1).

There are two antennas in the example of FIG. 3. A first of the two antennas is formed from antenna resonating element 54-1B and antenna ground plane 54-2. A second of the two antennas is formed from antenna resonating element 54-1A and ground plane 54-2. In addition to antenna resonating element 54-1B, the first antenna may have a slot antenna resonating element. The slot antenna resonating element may be provided in the form of one or more openings in antenna ground plane 54-2 in the vicinity of antenna resonating element 54-1A. Because antenna resonating elements such as elements 54-1A and 54-1B and the slot antenna resonating element are used to support far-field communications (e.g., to transmit radio-frequency signals to external equipment and to receive radio-frequency signals from external equipment), antenna resonating elements such as these are sometimes referred to as antenna radiating elements.

Resonating element 54-1B in antenna 54 may be formed from an elongated resonating element structure such as an L-shaped strip or arm (branch). Multibranch structures and structures with planar portions may be used for resonating element 54-1B if desired. Resonating element 54-1B may be formed from any suitable conductive structure such as a length of wire, a strip of metal foil or other conductor, or traces on a flex circuit, etc.

An advantage of using dielectric for housing portions 12-2A and 12-2B is that this allows the antennas of device 10 to operate without interference from the metal sidewalls of housing 12. With one suitable arrangement, housing portions 12-2A and 12-2B may be plastic caps formed from a plastic based on acrylonitrile-butadiene-styrene copolymers (sometimes referred to as ABS plastic). These are merely illustrative housing materials for device 10. For example, the housing of device 10 may be formed substantially from plastic or other dielectrics, substantially from metal or other conductors, or from any other suitable materials or combinations of materials.

Components such as components 52 may be mounted on circuit boards in device 10. The circuit board structures in device 10 may be formed from any suitable materials. Suitable circuit board materials include paper impregnated with phonolic resin, resins reinforced with glass fibers such as fiberglass mat impregnated with epoxy resin (sometimes referred to as FR-4), plastics, polytetrafluoroethylene, polystyrene, polyimide, and ceramics. Circuit boards fabricated from materials such as FR-4 are commonly available, are not cost-prohibitive, and can be fabricated with multiple layers of metal (e.g., four layers). So-called flex circuits, which are flexible circuit board materials such as polyimide, may also be used in device 10.

Typical components in device 10 include integrated circuits, LCD screens, and user input interface buttons. Device 10 also typically includes a battery, which may be mounted along the rear face of housing 12 (as an example).

Because of the conductive nature of components such as these and the printed circuit boards upon which these components are mounted, the components, circuit boards, and conductive housing portions (including bezel 14) of device 10 may be grounded together to form antenna ground plane 54-2. With one illustrative arrangement, ground plane 54-2 may conform to the generally rectangular shape of housing 12 and device 10 and may match the rectangular lateral dimensions of housing 12.

Any suitable conductive materials may be used to form ground plane element 54-2 and resonating elements 54-1A and 54-1B. Examples of suitable conductive materials for the antenna structures in device 10 include elemental metals, such as copper, silver, and gold, and metal alloys (e.g., beryllium copper). Conductors other than metals may also be used, if desired.

Components 52 may include transceiver circuitry (see, e.g., devices 44 of FIG. 2). The transceiver circuitry may be provided in the form of one or more integrated circuits and associated discrete components (e.g., filtering components). The transceiver circuitry may include one or more transmitter integrated circuits, one or more receiver integrated circuits, switching circuitry, amplifiers, etc. Each transceiver in the transceiver circuitry may have an associated coaxial cable, microstrip transmission line, or other transmission line that is connected to an associated antenna and over which radio frequency signals are conveyed. In the example of FIG. 3, transmission lines are depicted by dashed line 56.

Transmission lines 56 may be used to distribute radio-frequency signals that are to be transmitted through the antennas from a transmitter integrated circuit 52. Paths 56 may also be used to convey radio-frequency signals that have been received by an antenna to components 52. Components 52 may include one or more receiver integrated circuits for processing incoming radio-frequency signals.

As shown in the cross-sectional diagram of FIG. 3, it may be advantageous to locate the antennas in device 10 near the extremities of device 10 (e.g., at either end of device 10). If desired, the antenna formed from antenna resonating element 54-1A and ground plane 54-2 may be omitted. If this antenna is omitted from device 10, there may be additional space available for components 52 in housing 12 or the size of housing 12 may be reduced.

Part of the frequency response of antenna 54 may be obtained by forming an opening within ground plane 54-2 that resonates in a desired frequency band (e.g., the lower frequency band in a two-band arrangement). The opening, which is sometimes referred to as a slot, may have any suitable shape. For example, the slot may be rectangular, the slot may have curved sides, the slot may have any suitable number of straight sides, the slot may have a combination of straight sides and curved sides, etc.

In operation, the portion of antenna 54 that contains the slot forms a slot antenna. The slot antenna structure in antenna 54 can be used at the same time as a non-slot antenna resonating element (e.g., an L-shaped strip). In particular, antenna performance can be improved when operating antenna 54 as a hybrid device in which both its non-slot antenna resonating element operating characteristics and its slot antenna resonating element operating characteristics are present. In hybrid operation, the slot antenna portion of the antenna may provide a frequency response in a lower frequency communications band, whereas the L-shaped arm (or other non-slot portion) portion of the antenna may provide a frequency response in a higher frequency communications band (as an example).

Figure 4:
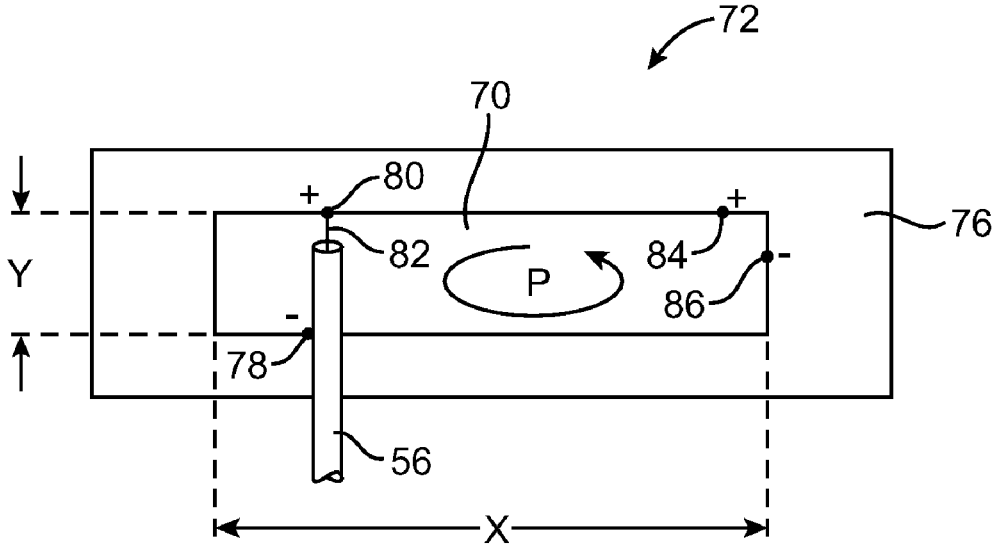
FIG. 4 is a top view of an illustrative slot antenna in accordance with an embodiment of the present invention.

A top view of an illustrative slot antenna is shown in FIG. 4. Antenna 72 of FIG. 4 is typically thin in the dimension into the page (i.e., antenna 72 is planar with its plane lying in the page). Slot 70 may be formed in the center of antenna 72. Slot 70 of FIG. 4 is shown as being rectangular in shape as an example, but in general, slot 70 may have any suitable shape.

Coaxial cable 56 or any other suitable transmission line may be used to feed antenna 72. In the example of FIG. 4, antenna 72 is fed so that positive or center conductor 82 of coaxial cable 56 is connected to signal terminal 80 (i.e., the positive terminal of antenna 72) and the outer braid of coaxial cable 56, which forms the ground conductor for cable 56, is connected to ground terminal 78. Antenna terminals such as terminals 80 and 78 are sometimes referred to as feed terminals or are said to form an antenna feed. Because signals from transmission line 56 are applied to the slot resonating element of antenna 72 directly through the antenna's positive and ground terminals, arrangements such as the one shown in FIG. 4 are sometimes referred to as direct feed arrangements.

Figure 5:
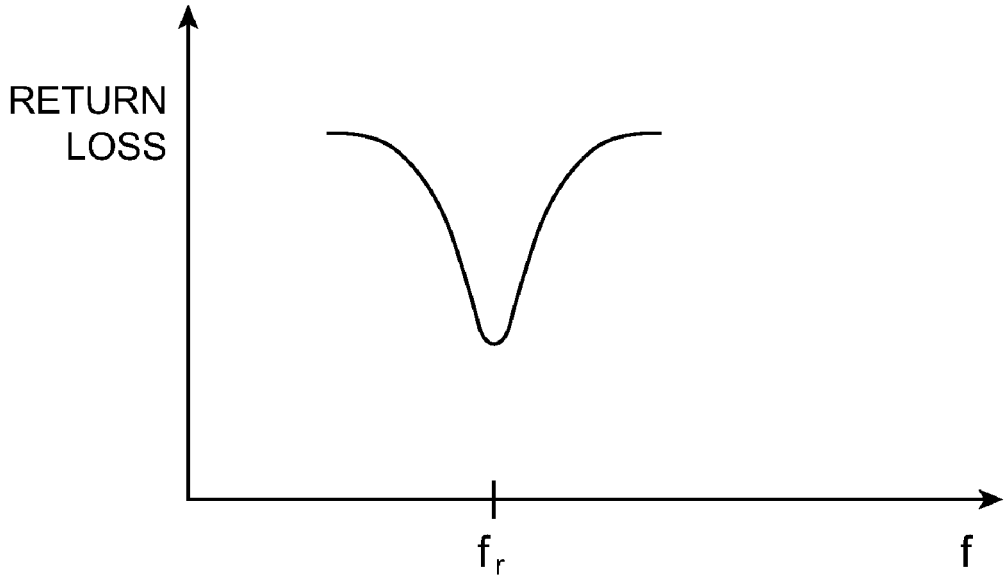
FIG. 5 is an illustrative antenna performance graph for an antenna of the type shown in FIG. 4 in which return loss values are plotted as a function of operating frequency in accordance with an embodiment of the present invention.

When the slot antenna resonating element of antenna 72 is directly fed using an arrangement of the type shown in FIG. 4, the antenna's performance is given by the graph of FIG. 5. As shown in FIG. 5, antenna 72 operates in a frequency band that is centered about center or resonant frequency $f_r$. The center frequency $f_r$ is determined by the dimensions of slot 70. Slot 70 of FIG. 4 has an inner perimeter P that is equal to two times dimension X plus two times dimension Y (i.e., P=2X+2Y). At center frequency $f_r$, perimeter P is equal to one wavelength. The position of terminals 80 and 78 may be selected for impedance matching. If desired, terminals such as terminals 84 and 86, which extend around one of the corners of slot 70 may be used to directly feed antenna 72, provided that the distance between terminals 84 and 86 is chosen to properly adjust the impedance of antenna 72. Optional impedance matching network components may also be used for impedance matching.

In the illustrative arrangement of FIG. 4, terminals 84 and 86 are shown as being respectively configured as a slot antenna ground terminal and a slot antenna signal terminal, as an example. If desired, terminal 84 could be used as a ground terminal and terminal 86 could be used as a signal terminal. Slot 70 is typically an air-filled slot, but may, in general, be filled with any suitable dielectric. If desired, space may be conserved in handheld electronic device 10 by allowing components in device 10 to be placed in the vicinity of slot 70. For example, dielectric parts or small conductive parts may impinge somewhat on slot 70 without preventing antenna 72 from functioning properly.

Figure 6:
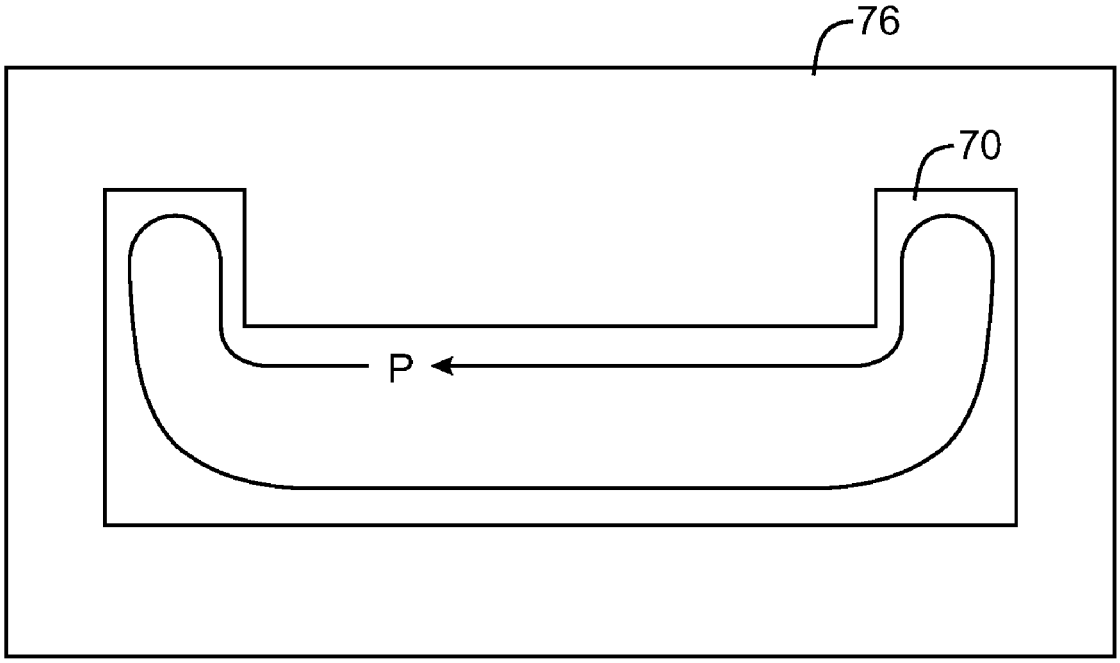
FIG. 6 is a top view of an illustrative non-rectangular slot antenna structure in accordance with an embodiment of the present invention.

An arrangement in which slot 70 has a non-rectangular shape is shown in FIG. 6.

The shape of slot 70 may be defined by the shape of an opening in planar ground plane elements such as a printed circuit board or other mounting structure. The shape of slot 70 may also be defined by the layout of conductive components within device 10. For example, on end of a rectangular slot may be defined by the presence of a component with metal parts.

Figure 7:
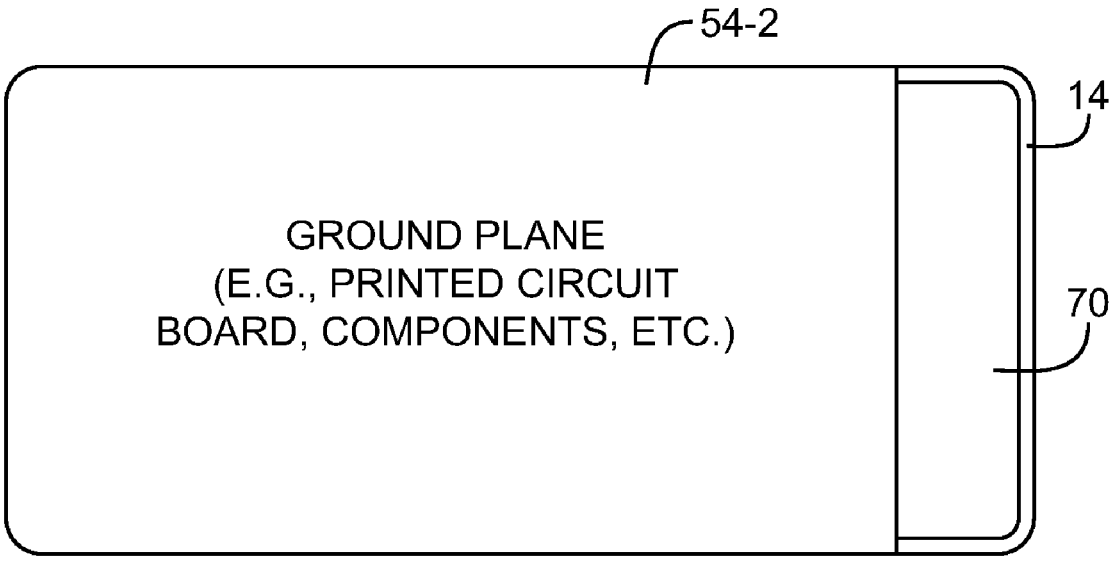
FIG. 7 is a top interior view of an illustrative handheld electronic device in which a slot antenna structure has a shape determined by the relative positions of a conductive bezel and a ground plane structure in accordance with an embodiment of the present invention.

With one suitable arrangement, the shape of slot 70 is defined by an opening that is formed by bezel 14 and the printed circuit board structures, planar housing surfaces, and conductive components 52 in device 10 that form ground plane 54-2. An illustrative arrangement of this type is shown in FIG. 7. In the example of FIG. 7, slot 70 has a shape that is determined by the size and shape of the opening formed between conductive bezel 14 (which may be considered to be part of ground plane 54-2) and the other portions of ground plane 54-2. Slots whose shapes are determined in this way may have any suitable shape (e.g., rectangular, irregular shapes with curved and straight sides, etc.). An advantage of using bezel 14 to form part of the sides of slot 70 and thereby determine the shape of slot 70 is that this allows a conductive bezel to be formed around the entire periphery of device 10 while locating antenna 54 near to one of the ends of device 10.

Any suitable feed arrangement may be used to feed antenna 54. With one suitable arrangement, which is described herein as an example, the slot antenna resonating element of antenna 54 is directly fed (e.g., using antenna feed terminals such as positive antenna terminal 80 or 84 of FIG. 4 and ground antenna terminals such as ground antenna terminal 78 or 86 in FIG. 4).

In a direct feeding arrangement for the slot of antenna 54, a ground conductor in a coaxial cable or other transmission line 56 may be coupled to an antenna ground terminal on one portion of the slot's periphery while a center or positive conductor in a coaxial cable or other transmission line 56 may be coupled to a positive antenna terminal on another portion of the slot's periphery. The ground and positive antenna terminals may, for example, be located on opposite sides of a slot that has a rectangular portion as shown in FIG. 4. In additional to the directly fed slot resonating element, antenna 54 also may have an additional resonating element. The additional resonating element may be formed using a non-slot structure that is indirectly fed. For example, this other antenna resonating element may be formed from an indirectly fed length of conductor or an indirectly fed planar structure.

With an indirect feed arrangement, the non-slot resonating element is coupled to the slot resonating element by near-field electromagnetic coupling, rather than being directly fed through the positive and ground antenna terminals. Due to this near-field electromagnetic interaction, transmitted signals from the transmission line can be coupled onto the non-slot resonating element by way of the directly fed slot resonating element. Similarly, signals can be received using the non-slot resonating element because the non-slot resonating element is near-field coupled to the slot antenna resonating element that is directly coupled to the transmission line.

By proper selection of the resonant frequencies for the directly fed slot antenna resonating element and the indirectly fed antenna resonating element, a desired amount of frequency coverage for antenna 54 may be obtained.

Figure 8:
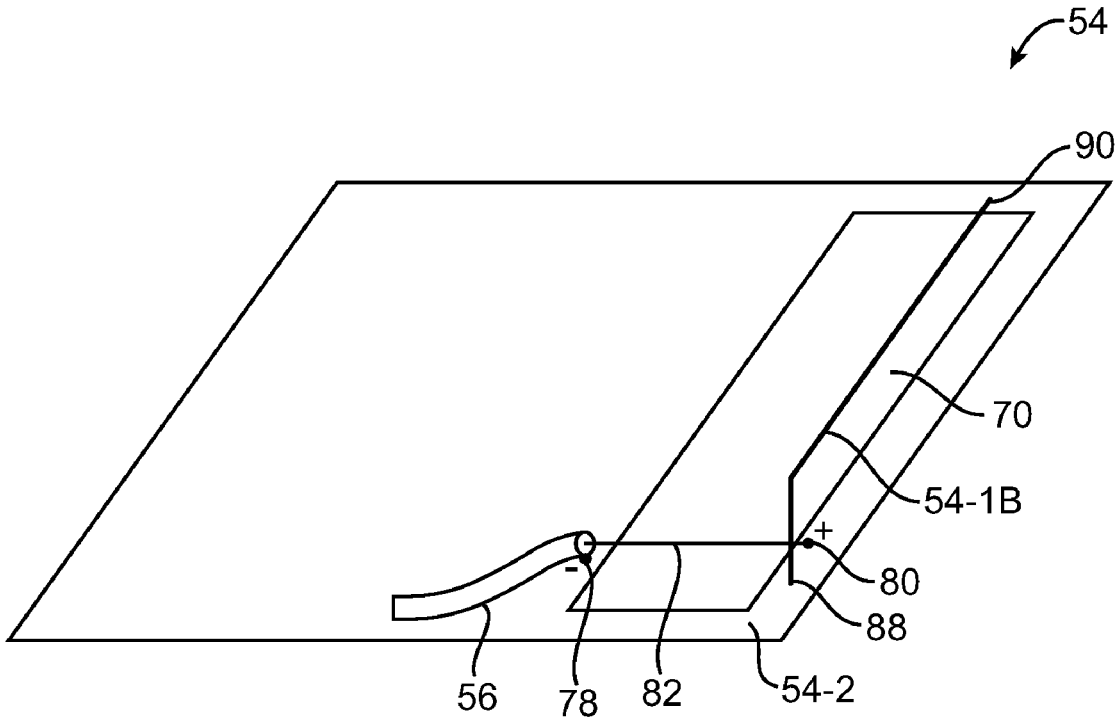
FIG. 8 is a perspective view of an illustrative antenna having a directly fed slot antenna resonating element and an indirectly fed (near-field coupled) L-shaped strip resonating element in accordance with an embodiment of the present invention.

An illustrative antenna having a slot antenna resonating element that is directly fed and a non-slot antenna resonating element that is indirectly fed is shown in FIG. 8. As shown in FIG. 8, antenna 54 may be fed by transmission line 56. Antenna 54 may have slot antenna resonating element 70 and L-shaped antenna resonating element 54-1B. Slot resonating element 70 may be formed from an opening in antenna ground plane 54-2. L-shaped antenna resonating element 54-1B may have one end (e.g., end 88) that is connected to ground plane 54-2 and another end (e.g., end 90) that is positioned away from ground plane 54-2. Ground plane 54-2 may serve as a ground plane for both the slot antenna portion of antenna 54 and the non-slot antenna portion of antenna 54.

Because antenna 54 has both slot and non-slot portions, antenna 54 may sometimes be referred to as a hybrid antenna.

In antenna 54 of FIG. 8, slot antenna resonating element 70 is shown as being directly fed, whereas non-slot antenna element 70 is shown as being indirectly fed. Slot 70 may be directly fed using any suitable arrangement. As shown in FIG. 8, for example, slot 70 may be directly fed by transmission line 56 at ground antenna terminal 78 and positive antenna terminal 80. A ground conductor associated with transmission line 56 may be connected to terminal 78. Center conductor 82 of transmission line 56 may be connected to positive terminal 80. Transmission line 56 may be a coaxial cable or any other suitable transmission line.

Slot resonating element 70 may have an antenna resonance at a frequency that is determined by its inner perimeter P, as described in connection with FIGS. 4 and 5. Resonating element 54-1B may have an antenna resonance at a frequency that is determined by its shape. For example, if resonating element 54-1B has a length L, resonating element 54-1B may resonate at a frequency at which L is equal to a quarter of a wavelength. These resonant frequencies need not be equal to each other and may or may not have other relationships with each other. For example, the slot resonant frequency may or may not be equal to a harmonic of the non-slot resonant frequency. The perimeter of slot 70 may be adjusted independently from the length (or other characteristic) associated with resonating element 54-1B, which allows an antenna designer to independently position the resonant peaks of slot 70 and antenna resonating element 54-1B.

Figure 9:
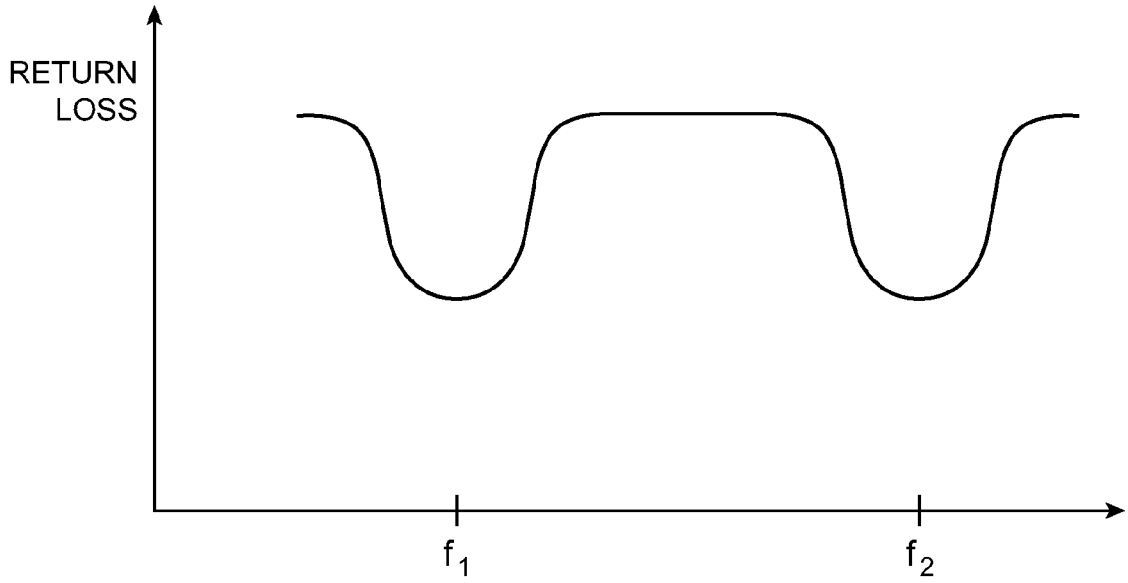
FIG. 9. is an antenna performance graph for an illustrative antenna having a directly fed slot antenna resonating element and an indirectly fed antenna resonating element in which return loss values are plotted as a function of operating frequency that shows how two separate communications bands may be covered in accordance with an embodiment of the present invention.

As shown in FIG. 9, for example, slot 70 and resonating element 54-1B may be configured so that antenna 54 covers two distinct communications bands—a first band that is centered at frequency $f_1$ and a second centered at frequency $f_2$. Slot 70 may be used to cover either the first or the second communications band, while element 54-1B may be used to cover the remaining band.

Figure 10:
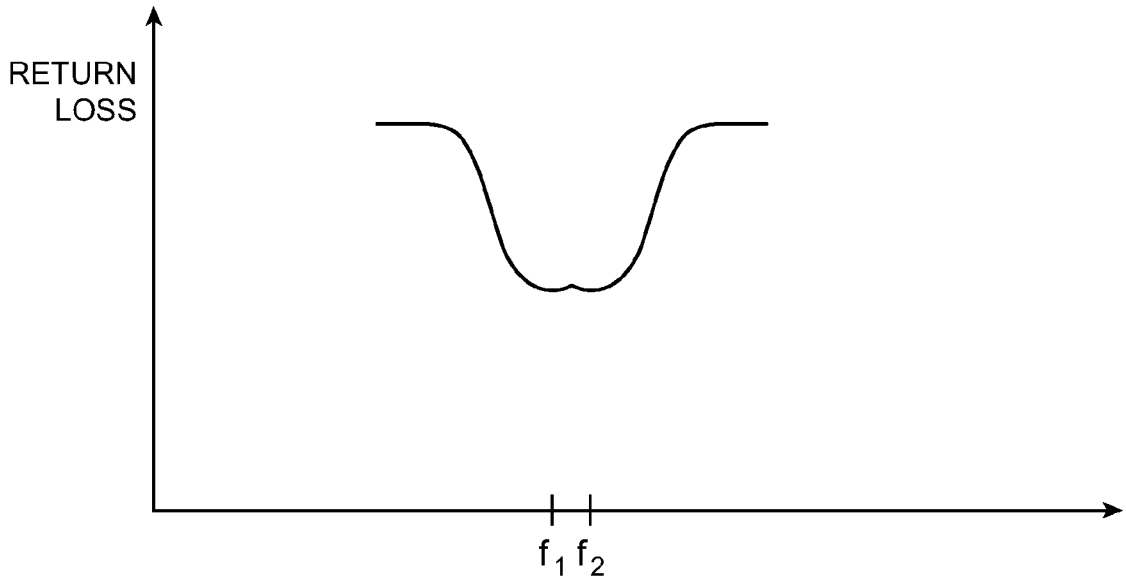
FIG. 10 is an antenna performance graph for an illustrative antenna having a directly fed slot antenna resonating element and an indirectly fed antenna resonating element in which return loss values are plotted as a function of operating frequency that shows how use of two resonating elements with overlapping resonant frequencies may broaden coverage for a single communications band in accordance with an embodiment of the present invention.

As shown in FIG. 10, slot 70 and resonating element 54-1B may be configured so that antenna 54 covers a single communications band. With the illustrative arrangement shown in FIG. 10, the resonant frequencies of the slot and the non-slot resonating element have been configured to be close to each other. As a result, the frequency responses of these portions of antenna 54 have merged to cover a single band.

If the resonant frequencies are configured to be the same (i.e., if slot 70 and element 54-1B are configured so that $f_1$ equals $f_2$), the resonant peak associated with slot 70 will coincide with the resonant peak associated with element 54-1B. This may improve antenna performance at or near the resonant frequency. For example, antenna 54 may exhibit improved immunity to the position of a user's hand on device 10 when compared to an antenna that does not contain both slot 70 and element 54-1B. Providing immunity to proximity effects in this way may make the wireless performance of device 10 more robust.

If the resonant frequencies are configured to be slightly different, one resonating element will cover a lower portion of the communications band, whereas the other resonating element will cover an upper portion of the communications band. This type of arrangement, which is depicted in FIG. 10 allows the bandwidth of the antenna within a desired communications band to be broadened and may improve immunity to proximity effects.

Figure 11:
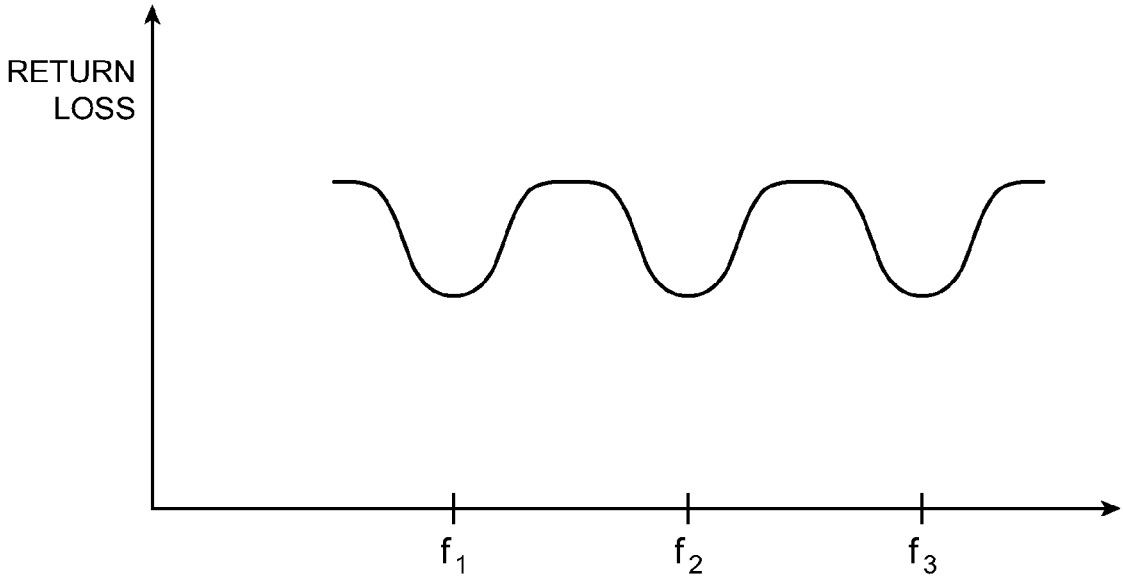
FIG. 11 is an antenna performance graph for an illustrative antenna having a directly fed slot antenna resonating element and an indirectly fed antenna resonating element in which return loss values are plotted as a function of operating frequency that shows how more than two communications bands may be covered in accordance with an embodiment of the present invention.

Another suitable arrangement is shown in FIG. 11. In the example of FIG. 11, slot 70 and element 54-1B are configured to cover more than two frequency bands. In particular, antenna 54 of FIG. 11 covers bands centered at frequencies $f_1$, $f_2$, and $f_3$. Slot 70 and element 54-1B may, for example, be configured to cover two of these bands. The third band may be covered by a harmonic of either slot 70 or element 54-1B. If desired, more than three bands may be covered by using additional harmonics.

Figure 12:
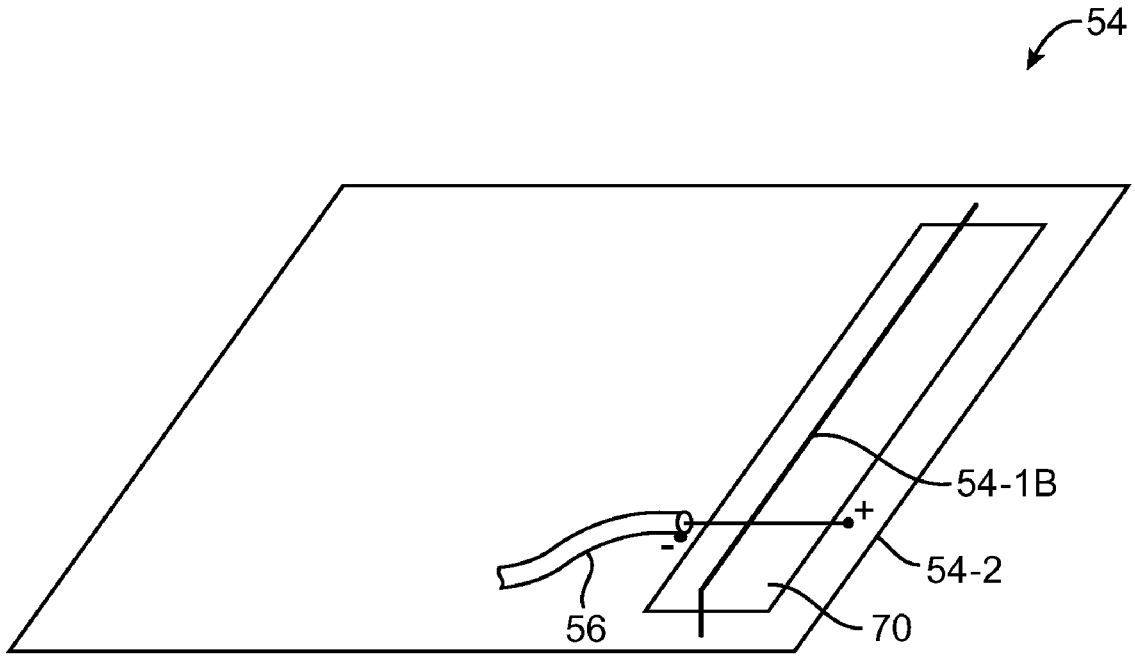
FIGS. 12, 13, 14, and 15 are perspective views of illustrative antennas having directly fed slot antenna resonating elements and indirectly fed (near-field-coupled) antenna resonating elements in accordance with embodiments of the present invention.

It is not necessary for resonating element 54-1B to be placed on one side of slot 70 as shown in the illustrative arrangement of FIG. 8. For example, resonating element 54-1B may be located so that most or all of element 54-1B overlaps slot 70, as shown in FIG. 12.

Figure 13:
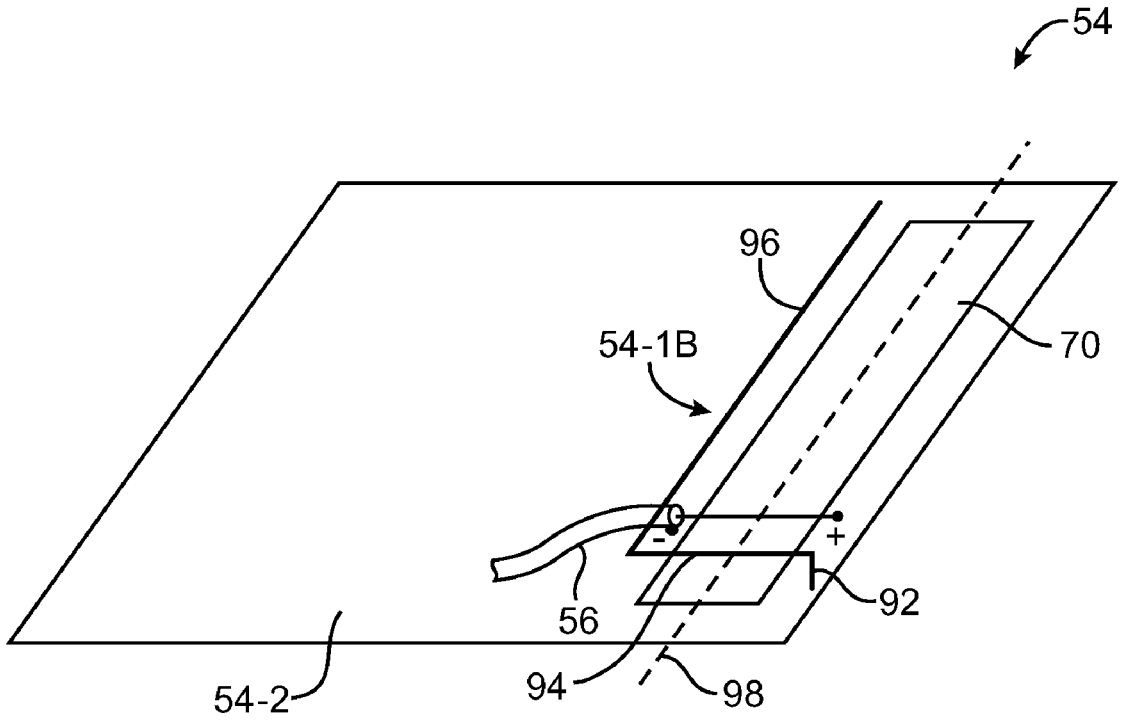

Another suitable arrangement is shown in FIG. 13. As shown by the illustrative antenna configuration of FIG. 13, antenna 54 may have a resonating element such as resonating element 54-1B that is not L-shaped. Illustrative resonating element 54-1B of FIG. 13 has three portions. A first portion (portion 92) extends vertically away from ground plane 54-2 (which may be formed by planar structures such as housing surfaces, electrical components, and circuit boards). A second portion (portion 94) extends parallel to ground plane 54-2 and runs across slot 70 perpendicular to longitudinal axis 98 of slot 70. A third portion (portion 96) extends parallel to ground plane 54-2 and runs parallel to longitudinal axis 98.

Figure 14:
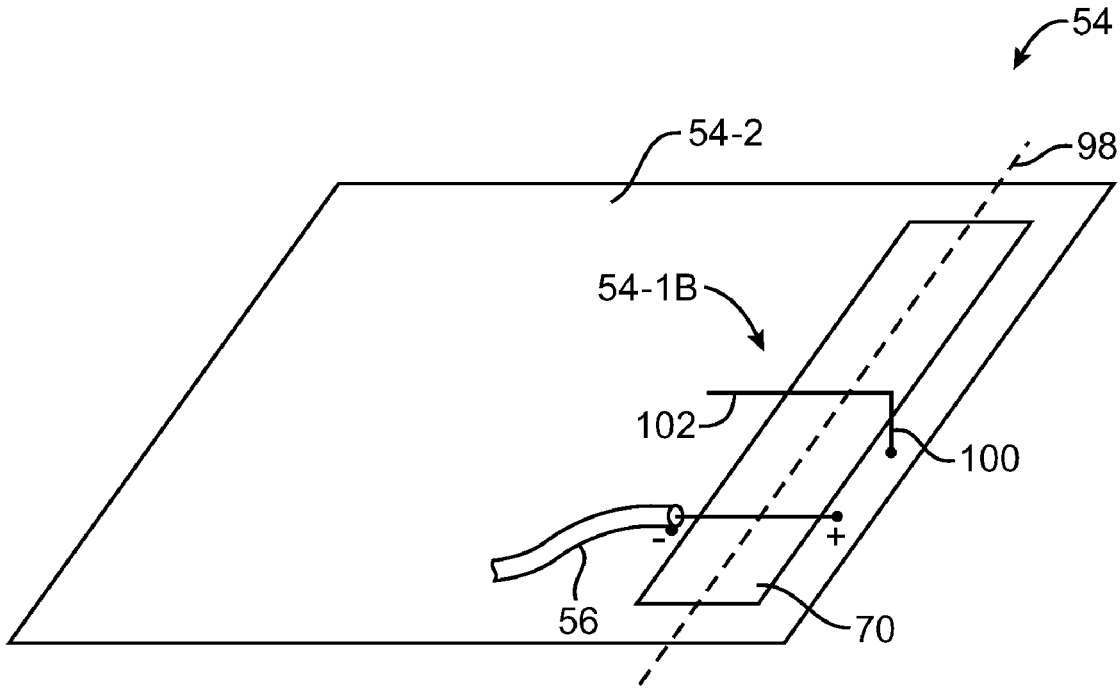

With the illustrative configuration of FIG. 14, antenna resonating element 54-1B has vertically extending portion 100 and horizontally extending portion 102. Portion 100 may be perpendicular to ground plane 54-2. Portion 102 may extend parallel to ground plane 54-2 across slot 70 and may be configured to be perpendicular to longitudinal axis 98 of slot 70.

Figure 15:
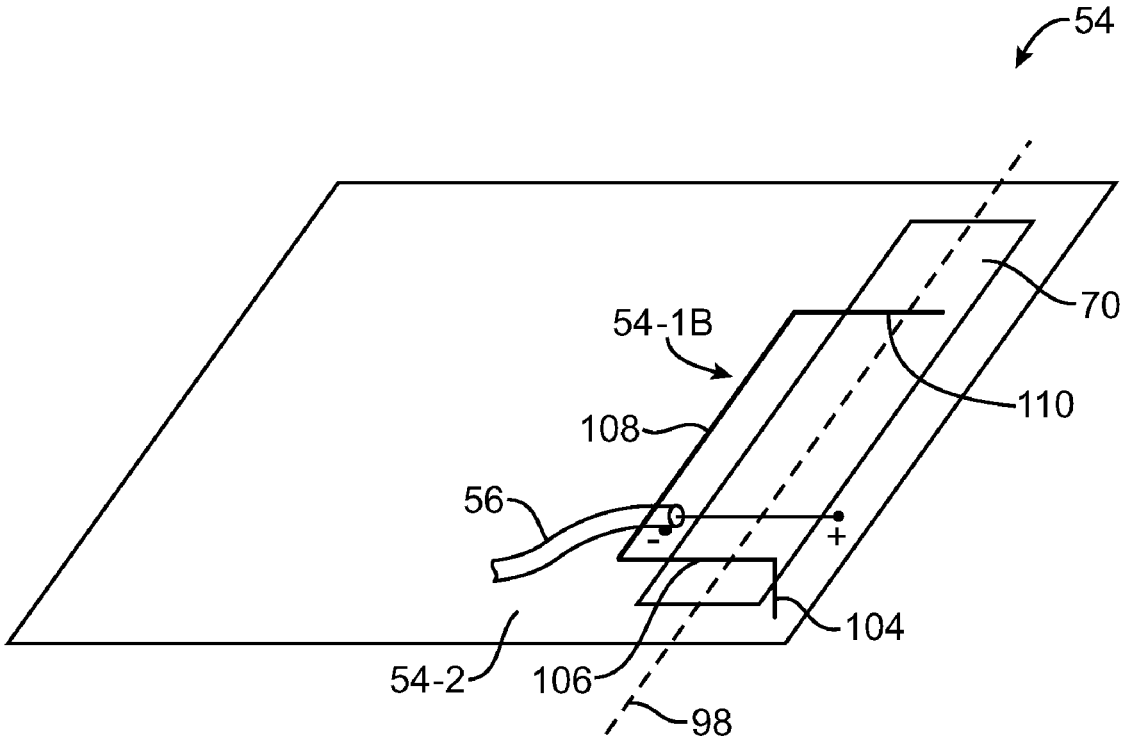

FIG. 15 shows an illustrative configuration for antenna resonating element 54-1B in which element 54-1B has multiple portions crossing slot 70. Vertical member 104 may extend upwards from ground plane 54-2. Antenna resonating element portion 106 may extend across slot 70 perpendicular to slot longitudinal axis 98. Portion 108 of antenna resonating element 54-1B may extend parallel to ground plane 54-2 and longitudinal axis 98. Portion 110 may cross slot 70 and may be perpendicular to longitudinal axis 98.

Figure 16:
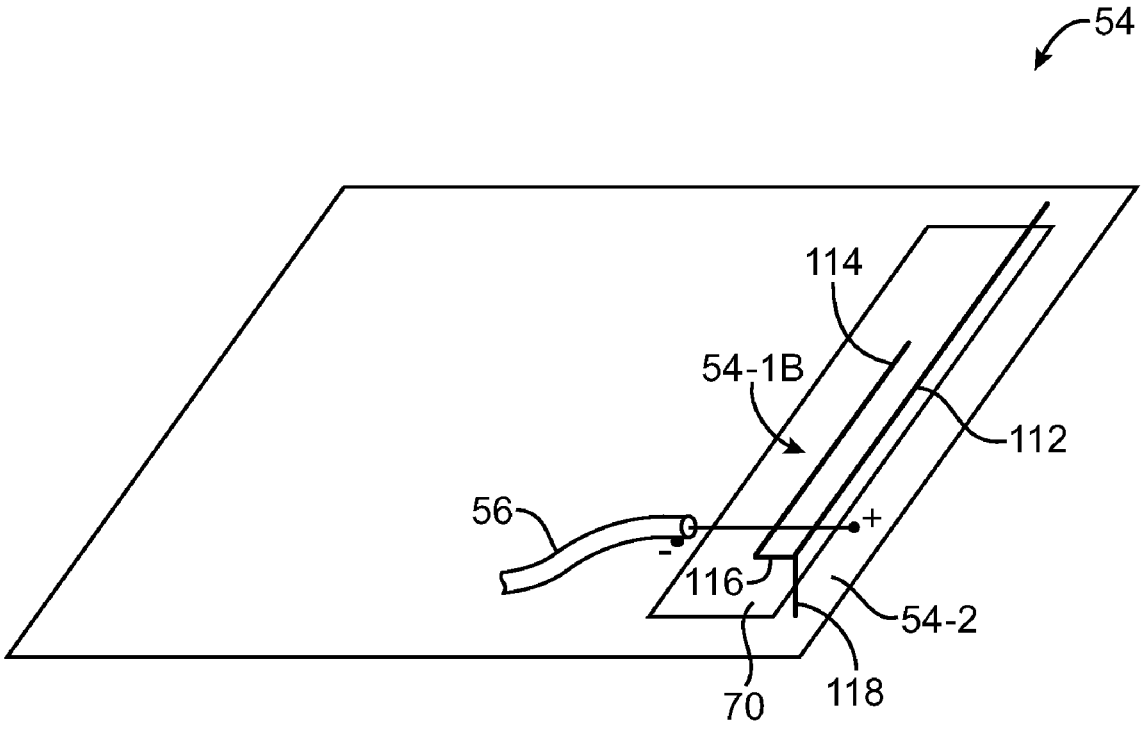
FIG. 16 is a perspective view of an illustrative antenna having a directly fed slot antenna resonating element and an indirectly fed multibranch antenna resonating element in accordance with an embodiment of the present invention.

As shown in FIG. 16, antenna resonating element 54-1B may have multiple branches. In the illustrative configuration of FIG. 16, antenna resonating element 54-1B has branch 112 and branch 114. Conductor 116 may be used to connect branch 114 to vertical resonating element portion 118. Although resonating element 54-1B of FIG. 16 has two branches, antenna 54 may, in general, be formed using an antenna resonating element with any suitable number of branches (e.g., three or more branches). The branches of antenna resonating element 54-1B may have different lengths. For example, one branch (such as branch 112 of FIG. 16) may have a relatively longer length, so that it resonates at a relatively lower frequency, whereas another branch (such as branch 114 of FIG. 16) may have a relatively shorter length, so that it resonates at a relatively higher frequency. The frequency peaks associated with the different branches may be used to cover different communications bands of interest, to increase the antenna bandwidth associated with a given communications band or bands, etc.

The illustrative antenna arrangements of FIG. 8 and FIGS. 12-16 are merely illustrative. Antenna resonating elements such as these may be provided with additional bends, fewer bends, curved lengths of conductor, different numbers of branches, or other shapes or structures if desired. The lengths of conductor in these antenna resonating elements may be formed from wires, conductive traces (e.g., traces on a flex circuit substrate), portions of metal foil, or other suitable conductive structures.

If desired, antenna 54 may be formed from a directly fed slot and an indirectly fed planar antenna resonating element.

Figure 17:
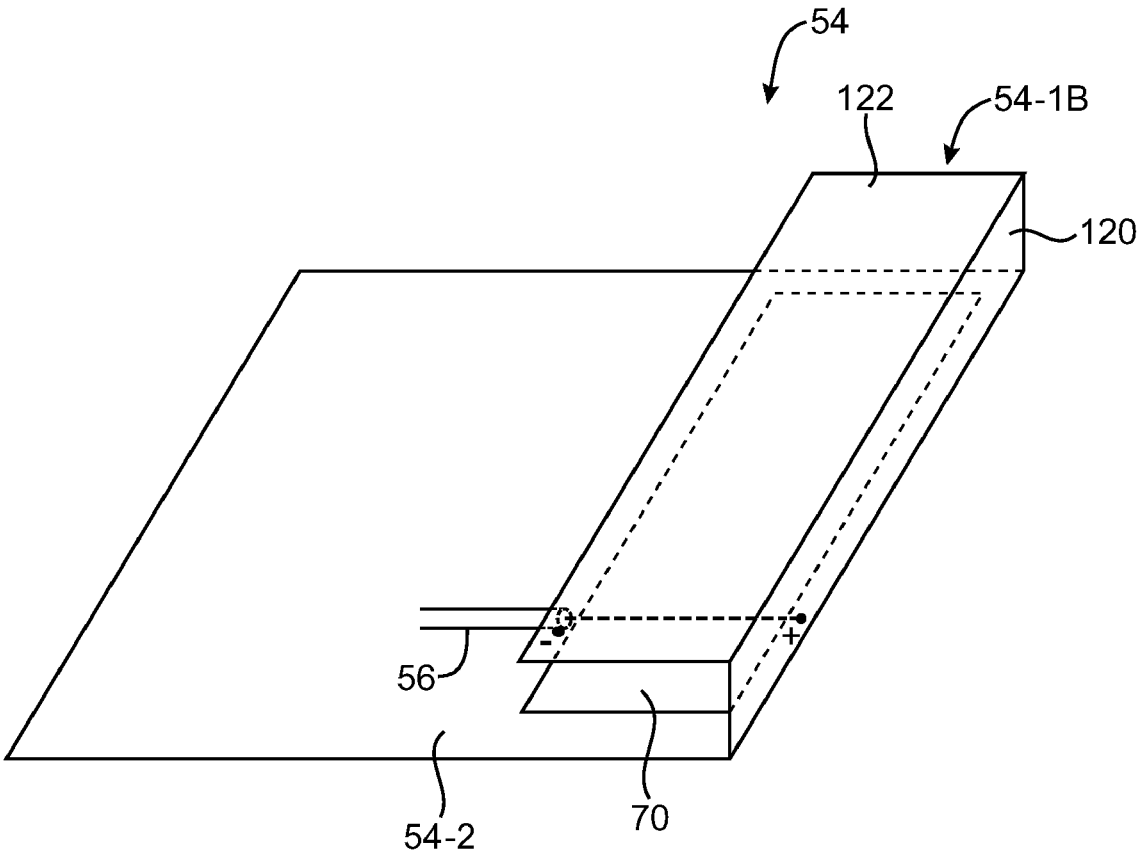
FIG. 17 is a perspective view of an illustrative antenna having a directly fed slot antenna resonating element and an indirectly fed planar antenna resonating element in accordance with an embodiment of the present invention.

An illustrative antenna configuration of this type is shown in FIG. 17. As shown in FIG. 17, slot resonating element 70 may be directly fed by transmission line 56 using ground and positive antenna terminals located (for example) on opposite sides of slot 70. In the arrangement of FIG. 17, antenna resonating element 54-1B has at least one conductive structure that is planar (i.e., planer upper portion 122). Antenna resonating element 54-1B also preferably has at least one conductive structure that connects the planar structure to ground plane 54-2.

Planar portion 122 may be parallel to ground plane 54-2. A vertical conductive structure such as planar conductive structure 120 may be used to connect planar structure 122 to ground plane 54-2. If desired, other conductive structures may be used to connect planar antenna structures in resonating element 54-1B to ground plane 54-2. For example, wires, strips of conductor, multiple vertical planar elements, or other suitable conductors may be used to connect planar antenna portion 122 to ground.

The electrical properties of planar structures such as planar antenna resonating element 54-1B may differ from those of substantially non-planar structures (e.g., those based on L-shaped wires or narrow traces on a flex circuit). For example, planar structures of the type shown in antenna resonating element 54-1B of FIG. 17 may exhibit a broader frequency response than non-planar antenna resonating elements.

Figure 18:
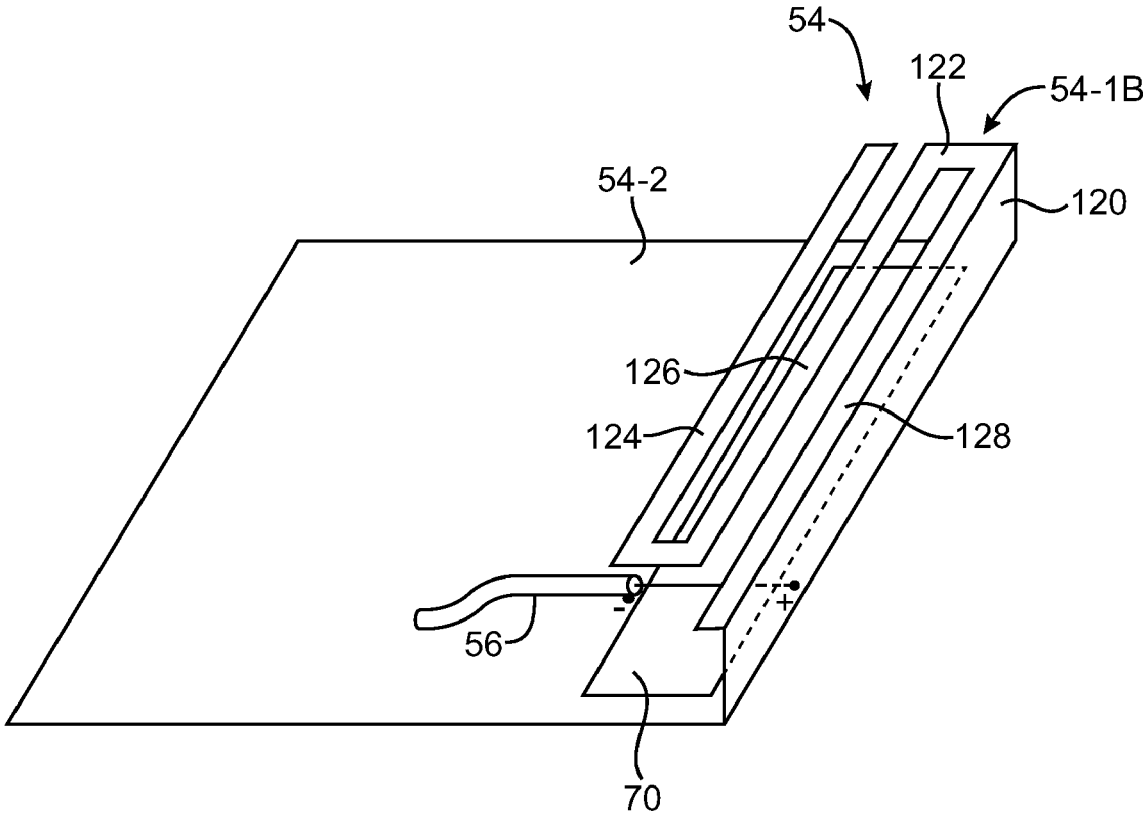
FIG. 18 is a perspective view of an illustrative antenna having a directly fed slot resonating element and an indirectly fed planar antenna resonating element with a serpentine path in accordance with an embodiment of the present invention.

If desired, other planar shapes may be used for antenna resonating element 54-1B. For example, planar portion 122 of antenna resonating element 54-1B may be implemented using a planar conductor that is configured to form a serpentine path as shown in FIG. 18. In the FIG. 18 example, resonating element 54-1B has planar upper portion 122 and vertical portion 120. Planar upper portion 122 has a serpentine path formed of path portion 128, path portion 126, and path portion 124. The length of the serpentine path (approximately equal to three times the length of an individual one of the path segments) may help establish the resonant frequency of antenna resonating element 54-1B. For example, if resonating element 54-1B has a portion 122 with a total length L for its serpentine path, resonating element 54-1B may resonate at a frequency at which L is equal to a quarter of a wavelength.

Figure 19:
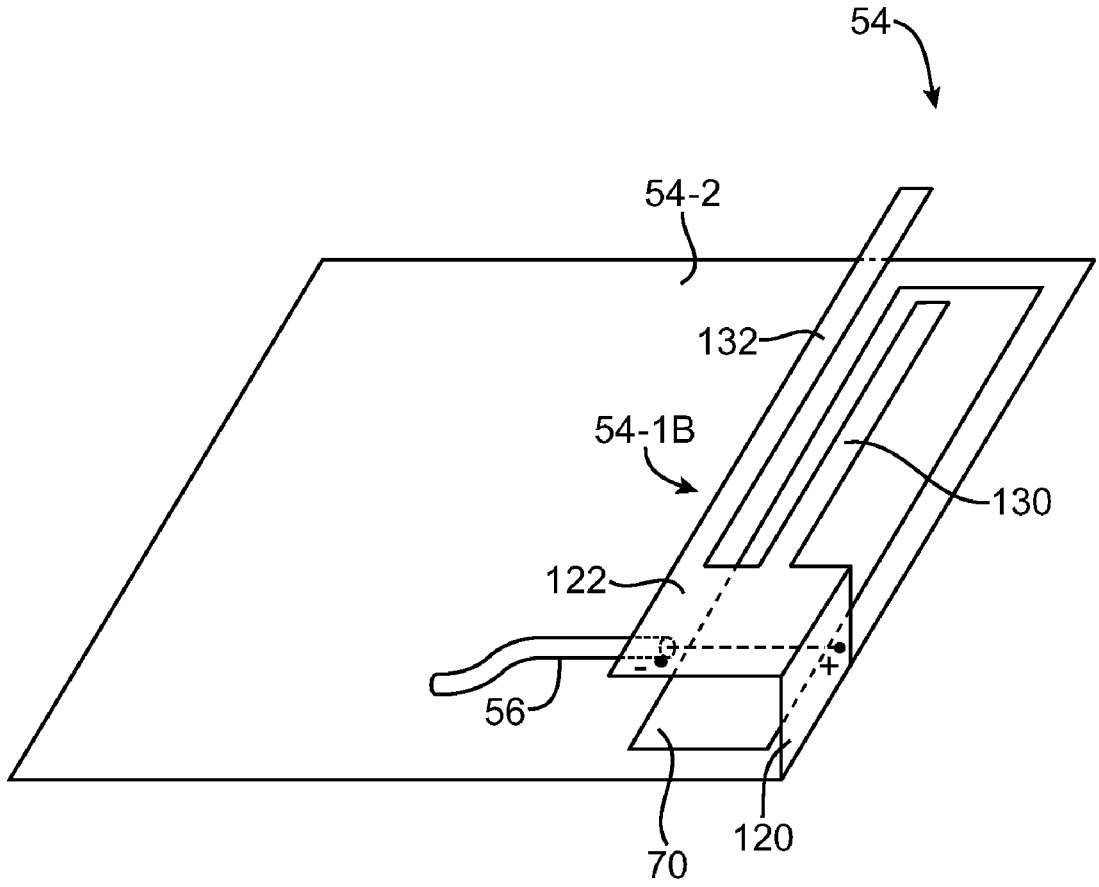
FIG. 19 is a perspective view of an illustrative antenna having a directly fed slot resonating element and an indirectly fed multibranch planar antenna resonating element in accordance with an embodiment of the present invention.

If desired, planar antenna resonating elements may be provided with multiple branches (arms). An illustrative arrangement in which planar portion 122 of antenna resonating element 54-1B has two branches is shown in FIG. 19. In this example, branch 130 is shorter than branch 132. To conserve space in device 10, branches such as branches 130 and 132 may fold back upon themselves one or more times as shown by the paths 124, 126, and 128 in the serpentine path example of FIG. 18. There may be any suitable number of branches in antenna resonating element 54-1B (e.g. two branches, more than two branches, etc.). The use of multiple branches in a planar antenna resonating element such as antenna resonating element 54-1B of FIG. 19 may help broaden antenna coverage in a particular band or bands or may help the antenna cover additional communications bands.

Figure 20:
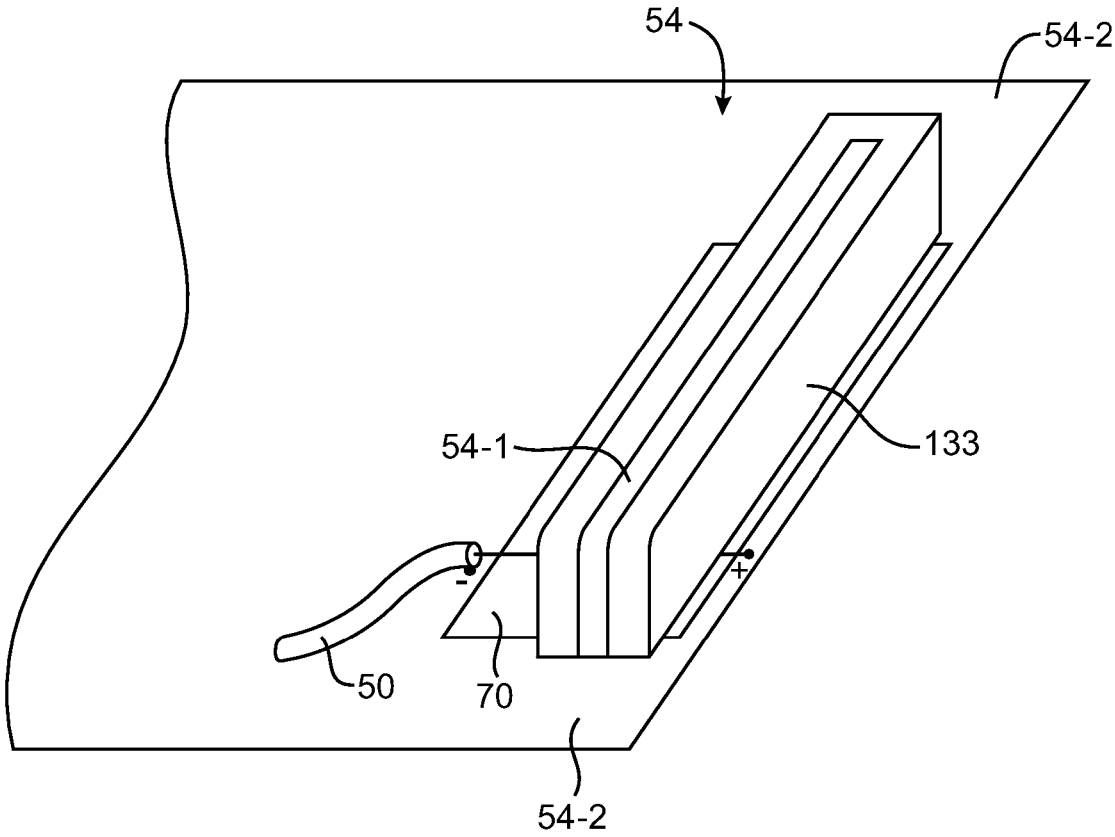
FIG. 20 is a perspective view of an illustrative antenna having a directly fed slot antenna resonating element and an indirectly fed antenna resonating element in which the indirectly fed antenna resonating element is formed from a strip of conductor mounted on a support structure in accordance with an embodiment of the present invention.

As shown in FIG. 20, the conductive structures of antenna resonating element 54-1B may be supported using support structures such as support structure 133. In the example of FIG. 20, a conductive strip of metal or other suitable conductor has been formed on a dielectric support structure (structure 133). The conductive portion of antenna resonating element 54-1B may, for example, be formed from a strip of metal foil or a conductive trace on a flex circuit substrate (as examples). Any suitable antenna structures may be mounted using support structures such as support structure 133. For example, planar antennas and non-planar antennas may be supported in this way. Elements with multiple branches, bends, serpentine paths, etc. may also be supported using one or more antenna resonating element support structures. The configuration of FIG. 20 is merely illustrative.

Figure 21:
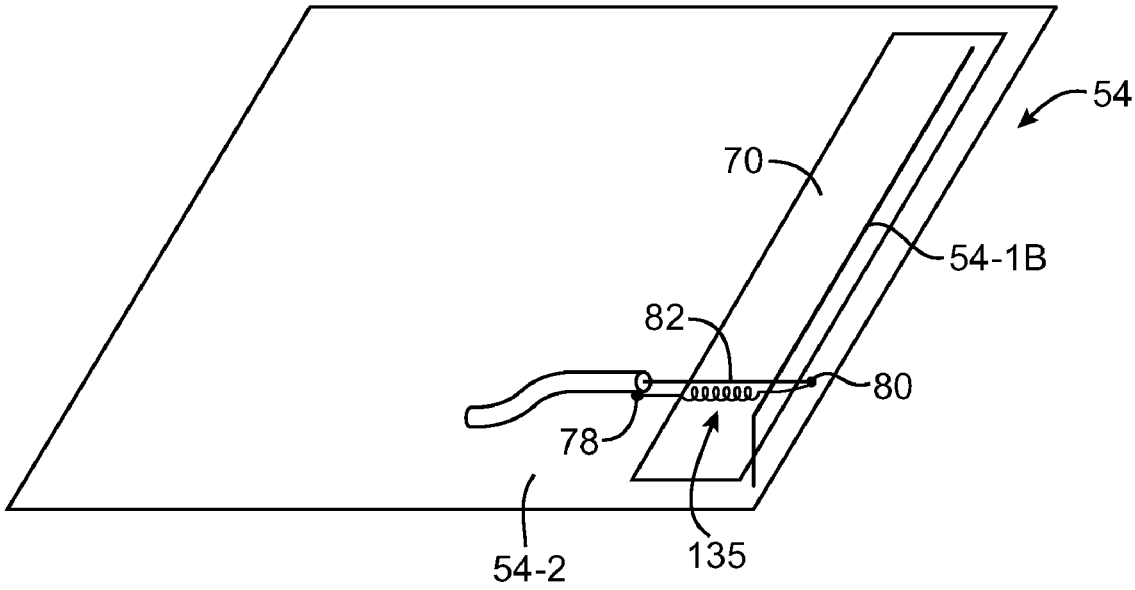
FIG. 21 is a perspective view of an illustrative antenna having a directly fed slot antenna resonating element and an indirectly fed antenna resonating element in which an inductor is placed across the terminals of the antenna in accordance with an embodiment of the present invention.

If desired, electrical components may be used to adjust the feed characteristics of antenna 52. For example, an inductor such as inductor 135 may be connected between the ground and positive antenna terminals 78 and 80 (e.g., for impedance matching to transmission line 56), as shown in FIG. 21.

Figure 22:
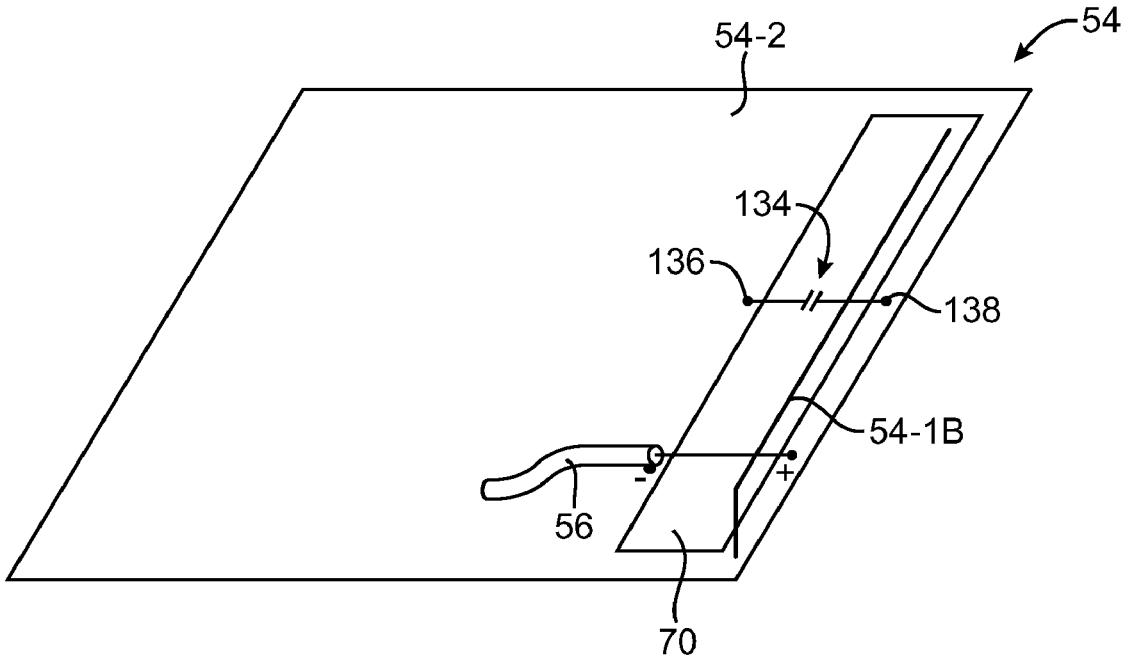
FIG. 22 is a perspective view of an illustrative antenna having a directly fed slot antenna resonating element and an indirectly fed antenna resonating element in which a capacitor is placed across the slot in accordance with an embodiment of the present invention.

As shown in FIG. 22, a capacitor such as capacitor 134 can be used to bridge slot 70. When capacitor 134 is electrically connected between terminals such as terminals 136 and 138 at different positions across slot 70, slot 70 behaves as if it has a larger perimeter P (i.e., by resonating at a lower frequency) at the expense of somewhat reduced efficiency and bandwidth. Arrangements such as the illustrative capacitor arrangement of FIG. 22 may be considered to be examples of antenna slot tuning networks.

Figure 23:
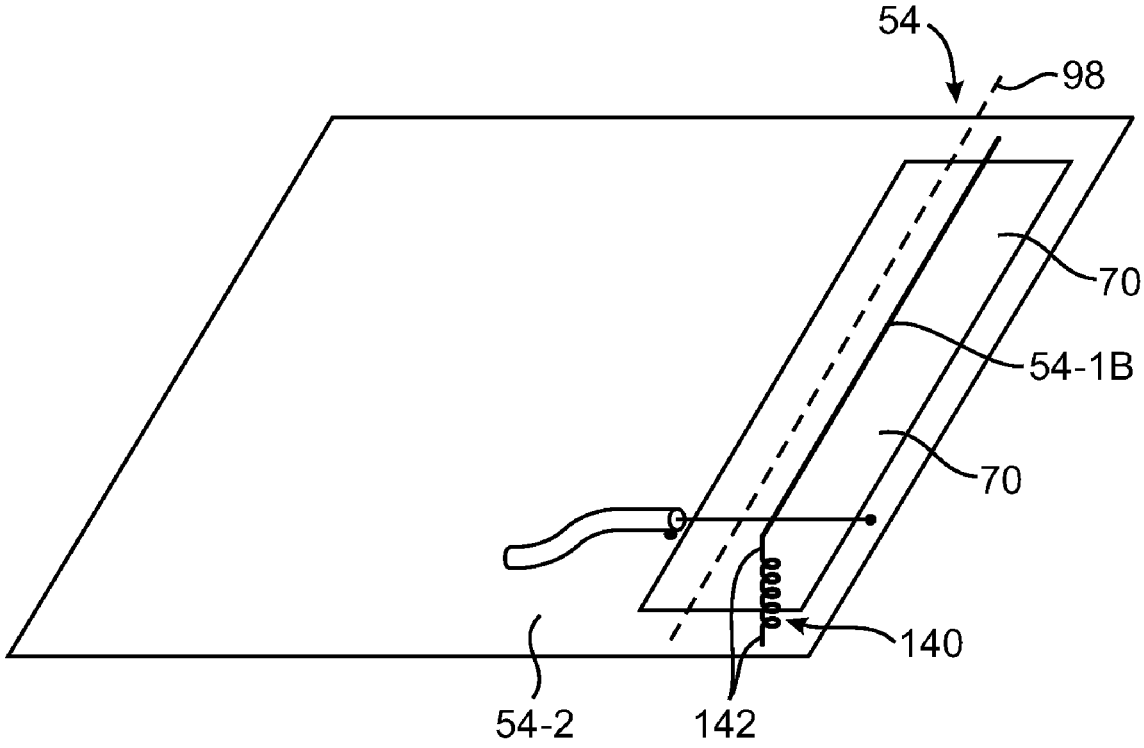
FIG. 23 is a perspective view of an illustrative antenna having a directly fed slot antenna resonating element and an indirectly fed antenna resonating element in which an inductor is coupled to the indirectly fed antenna resonating element in accordance with an embodiment of the present invention.

If desired, antenna 54 can be tuned by connecting electrical components to antenna resonating element 54-1B. For example, an inductor such as inductor 140 may be placed in vertical path portion 142 (or other suitable location) within antenna resonating element 54-1B as shown in FIG. 23. This type of configuration tends to make antenna resonating element 54-1B behave as if it were shorter than its actual length. In the example of FIG. 23, antenna resonating element 54-1B runs parallel to longitudinal axis 98 of slot 70.

Figure 24:
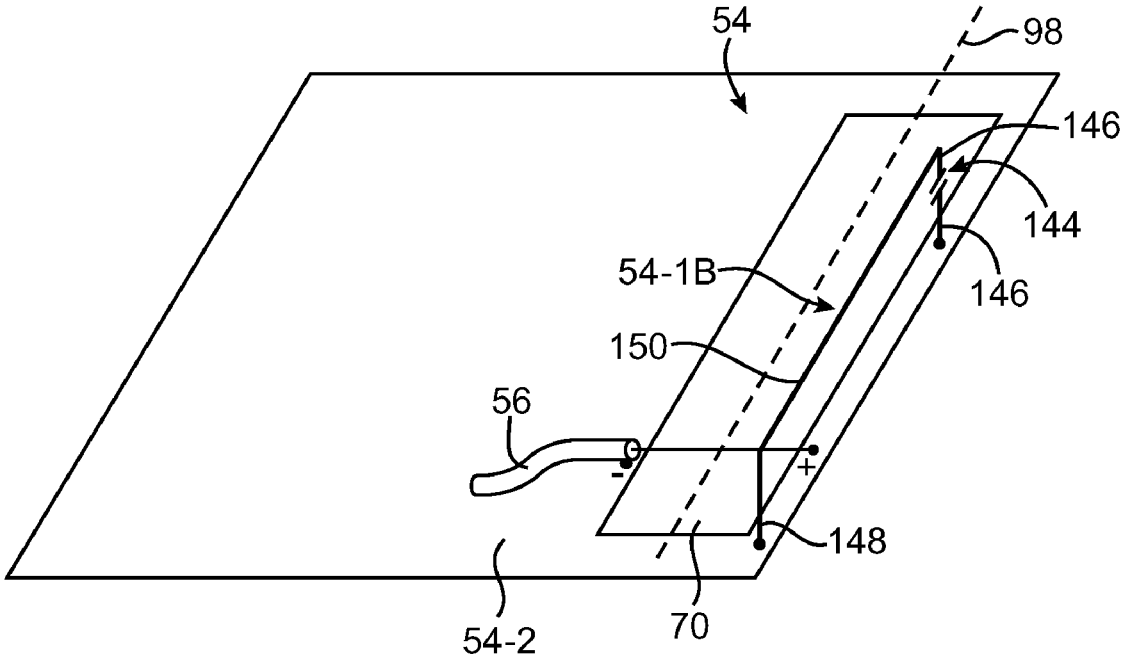
FIG. 24 is a perspective view of an illustrative antenna having a directly fed slot antenna resonating element and an indirectly fed antenna resonating element in which a capacitor is coupled to the indirectly fed antenna resonating element in accordance with an embodiment of the present invention.

As shown in FIG. 24, a capacitor such as capacitor 144 may be connected to antenna resonating element 54-1B. In the illustrative configuration of FIG. 24, antenna resonating element 54-1B is shown as having a vertical portion 148 that extends upwards from ground plane 54-2. Horizontal portion 150 of antenna resonating element 54-1B may run parallel to longitudinal axis 98 of slot 70. Vertical antenna resonating element portion 146 may connect horizontal portion 150 to ground plane 54-2. Capacitors such as capacitor 144 may be placed in the conductive path formed by portion 146. The presence of capacitor 144 in antenna 54 in the position shown in FIG. 24 makes antenna resonating element 54-1B behave as if it were physically longer than it is at the expense of antenna efficiency and bandwidth. For applications in which space is at a premium, it may be advantageous to place a capacitor in antenna 54 such as capacitor 144, as this may allow antenna resonating element 54-1B to meet space constraints while resonating at a desired resonant frequency for antenna 54.

Figure 25:
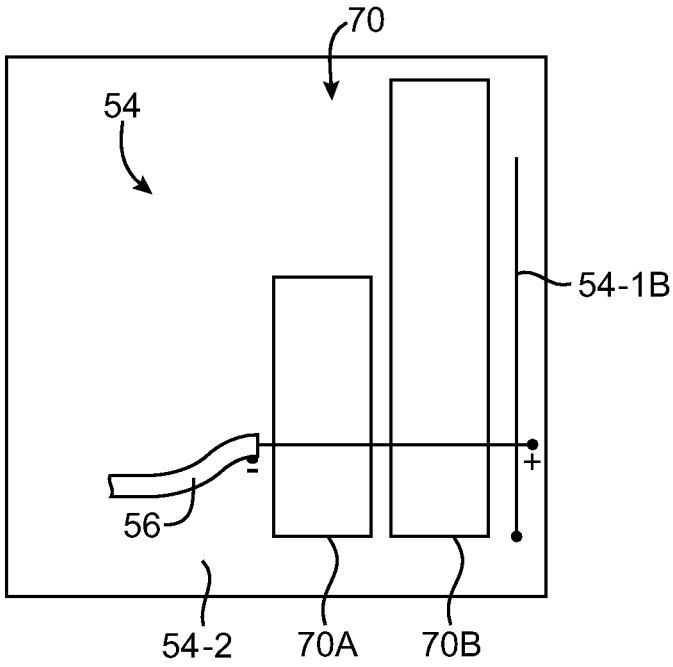
FIG. 25 is a top view of an illustrative slot antenna resonating element having two openings that may be used in an antenna in accordance with an embodiment of the present invention.

If desired, slot antenna resonating element 70 may be provided with multiple portions each of which has a different associated resonant frequency. As shown in FIG. 25, for example, antenna 54 may have a slot resonating element such as slot resonating element 70 that is formed from two openings in ground plane 54-2. In particular, slot resonating element 70 may be formed from a first opening in ground plane 54-2 such as slot resonating element 70A and a second opening in ground plane 54-2 such as slot resonating element 70B. Slots such as slots 70A and 70B may have different inner perimeters and may therefore have different associated resonant frequency peaks. In the illustrative arrangement of FIG. 25, slot 70A has a smaller inner perimeter than slot 70B, so it is expected that slot 70A will resonate at a higher frequency than slot 70B. If slots 70A and 70B are close in size, the resonant frequency contributions from each slot may merge and contribute to broader bandwidth coverage in a single communications band. If slots 70A and 70B are of substantially different sizes, each may help to establish a separate antenna resonant frequency that corresponds to a separate communications band. The size of slots such as slots 70A and 70B may be selected so that their associated antenna resonances coincide with or supplement the frequency coverage provided by near-field coupled antenna resonating element 54-1B. Although slot resonating element 70 of FIG. 25 is formed from two openings in ground plane 54-2, there may, in general, be any suitable number of ground plane openings in a given slot resonating element (e.g., three or more).

Figure 26:
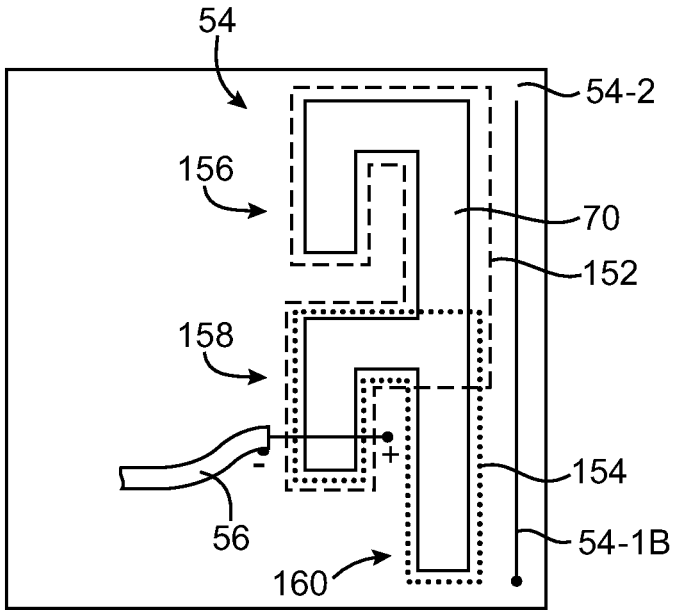
FIG. 26 is a top view of an illustrative multibranch slot antenna resonating element that may be used in an antenna in accordance with an embodiment of the present invention.

Another example is shown in FIG. 26. In this illustrative configuration, antenna 54 is formed from a slot that has multiple possible inner perimeters. In particular, slot resonating element 70 of FIG. 26 has portion 156, portion 158, and portion 160. Transmission line 56 may be used to directly feed branch 158 of slot 70. In this type of configuration, portions 156 and 158 may define a first slot portion having a first associated perimeter, as indicated by dashed line 152, whereas portions 158 and 160 may form a second slot portion having a second associated perimeter, as indicated by dotted line 154. Different feeding arrangements and different slot geometries may be used if desired. Such configurations may be used to produce slot perimeters that are close in length (e.g., when it is desired to broaden frequency coverage in a particular communications band), slot perimeters that are substantially different in length (e.g., when it is desired to provide antenna 54 with coverage in one or more additional communications bands, etc.). Additional perimeters may be provided by configuring slot 70 to have multiple separate openings (as with FIG. 25), multiple branches (as with FIG. 26), combinations of multiple openings and multiple branches, more than two or three openings or branches, or any other suitable configuration. Any of the antenna feeding arrangements, antenna resonating tuning arrangements, and geometries for antenna resonating element 54-1B may be used with any of the illustrative slot configurations if desired.

The foregoing is merely illustrative of the principles of this invention and various modifications can be made by those skilled in the art without departing from the scope and spirit of the invention.

What is claimed is:

1. A handheld electronic device antenna that is coupled to a transmission line, comprising:

a ground plane antenna element;

a slot antenna resonating element formed from an opening in the ground plane antenna element;

antenna terminals adjacent to the slot antenna resonating element with which the transmission line directly feeds the slot antenna resonating element; and a near-field-coupled antenna resonating element that is indirectly fed by the transmission line through near field coupling with the directly fed slot antenna resonating element, wherein the near-field-coupled antenna resonating element has multiple branches each of which is associated with a separate antenna resonant frequency.

2. The handheld electronic device antenna defined in claim 1 wherein the near-field-coupled antenna resonating element comprises an L-shaped length of conductor.

3. The handheld electronic device antenna defined in claim 1 wherein the near-field-coupled antenna resonating element comprises a length of conductor.

4. The handheld electronic device antenna defined in claim 1, wherein the ground plane element comprises at least one planar conductive structure, wherein the near-field-coupled antenna resonating element comprises a planar conductive resonating element structure that lies parallel to the planar conductive structure of the ground plane element.

5. The handheld electronic device antenna defined in claim 1 wherein the near-field-coupled antenna resonating element comprises a planar conductive structure.

6. The handheld electronic device antenna defined in claim 1 wherein the slot antenna resonating element has a longitudinal axis and wherein the near-field-coupled antenna resonating element comprises a length of conductor that runs parallel to the longitudinal axis.

7. The handheld electronic device antenna defined in claim 1 wherein the slot antenna resonating element has a longitudinal axis and wherein the near-field-coupled antenna resonating element comprises a length of conductor that runs perpendicular to the longitudinal axis and parallel to the ground plane element.

8. A handheld electronic device antenna that is coupled to a transmission line, comprising:

a ground plane antenna element;

a slot antenna resonating element formed from an opening in the ground plane antenna element;

antenna terminals adjacent to the slot antenna resonating element with which the transmission line directly feeds the slot antenna resonating element;

a near-field-coupled antenna resonating element that is indirectly fed by the transmission line through near field coupling with the directly fed slot antenna resonating element; and a capacitor, wherein the near-field-coupled antenna resonating element has an end at which the near-field-coupled antenna resonating element is connected to the ground plane element by the capacitor.

9. A handheld electronic device antenna that is coupled to a transmission line, comprising:

a ground plane antenna element;

a slot antenna resonating element formed from an opening in the ground plane antenna element;

antenna terminals adjacent to the slot antenna resonating element with which the transmission line directly feeds the slot antenna resonating element;

a near-field-coupled antenna resonating element that is indirectly fed by the transmission line through near field coupling with the directly fed slot antenna resonating element; and an inductor, wherein the near-field-coupled antenna resonating element has an end at which the near-field-coupled antenna resonating element is connected to the ground plane element by the inductor.

10. A handheld electronic device antenna that is coupled to a transmission line, comprising:

a ground plane antenna element;

a slot antenna resonating element formed from an opening in the ground plane antenna element;

antenna terminals adjacent to the slot antenna resonating element with which the transmission line directly feeds the slot antenna resonating element;

a near-field-coupled antenna resonating element that is indirectly fed by the transmission line through near field coupling with the directly fed slot antenna resonating element; and an inductor connected between the antenna terminals.

11. A handheld electronic device antenna that is coupled to a transmission line, comprising:

a ground plane antenna element;

a slot antenna resonating element formed from an opening in the ground plane antenna element;

antenna terminals adjacent to the slot antenna resonating element with which the transmission line directly feeds the slot antenna resonating element;

a near-field-coupled antenna resonating element that is indirectly fed by the transmission line through near field coupling with the directly fed slot antenna resonating element; and a capacitor that is connected across the slot antenna resonating element.

12. The handheld electronic device antenna element defined in claim 1 wherein the near-field-coupled antenna resonating element comprises a serpentine conductive path located above the slot antenna resonating element.

13. The handheld electronic device antenna defined in claim 1 wherein the slot antenna resonating element has portions defining multiple associated inner perimeters.

14. The handheld electronic device antenna defined in claim 1 wherein the slot antenna resonating element is formed from multiple distinct openings in the ground plane element.

* * * * *